US005307129A

United States Patent [19]

Miura et al.

[11] Patent Number: 5,307,129

[45] Date of Patent: Apr. 26, 1994

[54] IMAGE PROCESSING APPARATUS

[75] Inventors: Kanenori Miura; Shiro Suzuki; Yasuhito Takahashi; Masaru Ono, all of Kanagawa, Japan

[73] Assignee: Fuji Xerox Co., Ltd., Tokyo, Japan

[21] Appl. No.: 766,539

[22] Filed: Sep. 27, 1991

[30] Foreign Application Priority Data

Oct. 1, 1990 [JP] Japan ..... 2-263443
Oct. 1, 1990 [JP] Japan ..... 2-263444
Oct. 3, 1990 [JP] Japan ..... 2-265694

[51] Int. Cl.[5] ..... G03G 15/06
[52] U.S. Cl. ..... 355/260; 222/DIG. 1
[58] Field of Search ..... 355/260; 222/DIG. 1

[56] References Cited

U.S. PATENT DOCUMENTS

| | | | |
|---|---|---|---|
| 3,724,725 | 4/1973 | Stauffer | 222/DIG. 1 X |
| 4,739,907 | 4/1988 | Gallant | 222/DIG. 1 X |
| 4,744,493 | 5/1988 | Ikesue et al. | 222/DIG. 1 X |
| 4,924,920 | 5/1990 | Bhagwat | 355/260 X |
| 4,943,830 | 7/1990 | Sulenski | 222/DIG. 1 X |
| 5,025,289 | 6/1991 | Guslit et al. | 355/260 |
| 5,084,734 | 1/1992 | Yoshino et al. | 355/260 |

*Primary Examiner*—A. T. Grimley
*Assistant Examiner*—Nestor R. Ramirez
*Attorney, Agent, or Firm*—Finnegan, Henderson, Farabow, Garrett & Dunner

[57] ABSTRACT

In an image forming apparatus, a toner cartridge is removably set to a toner supply device and used while being set to the toner supply device, and the toner cartridge includes a main body with a toner supply port and a spiral agitator being disposed within the main body and rotated by drive means.

The apparatus also includes a reserve tank for a toner dispensing section including a toner container for containing toner supplied from a cartridge, and a toner supply section for receiving toner from the toner container and supplying the received toner to a developing unit. The toner container includes a spiral agitator for supplying toner to the toner supply section. An auger for transferring toner to the developing unit is disposed in the toner supply section. A toner transfer power of the spiral agitator is larger than that of the auger.

An empty detector is disposed at such a location that, unsoiled by toner leaked from the toner cartridge, the empty sensor can sense, within the reserve tank, such an amount of toner left in the reserve tank as to allow the toner to be dispensed a prescribed number of times. A display means is also provided for displaying an empty state of the reserve tank according to an empty signal derived from the empty sensor.

8 Claims, 19 Drawing Sheets

FIG. 2
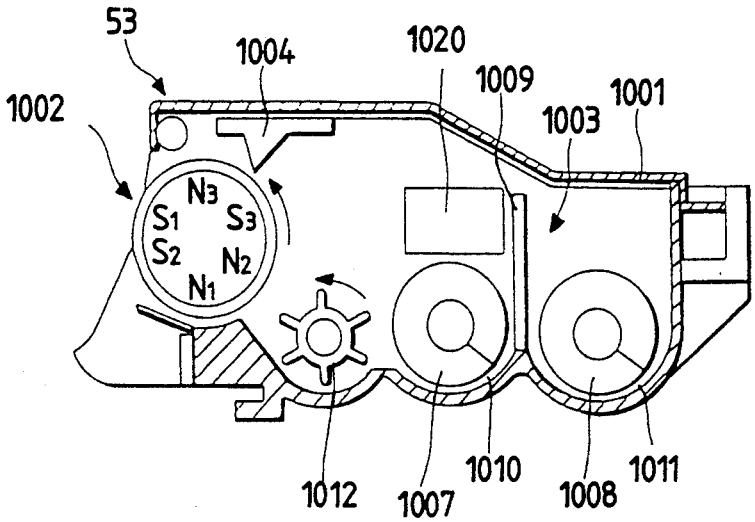
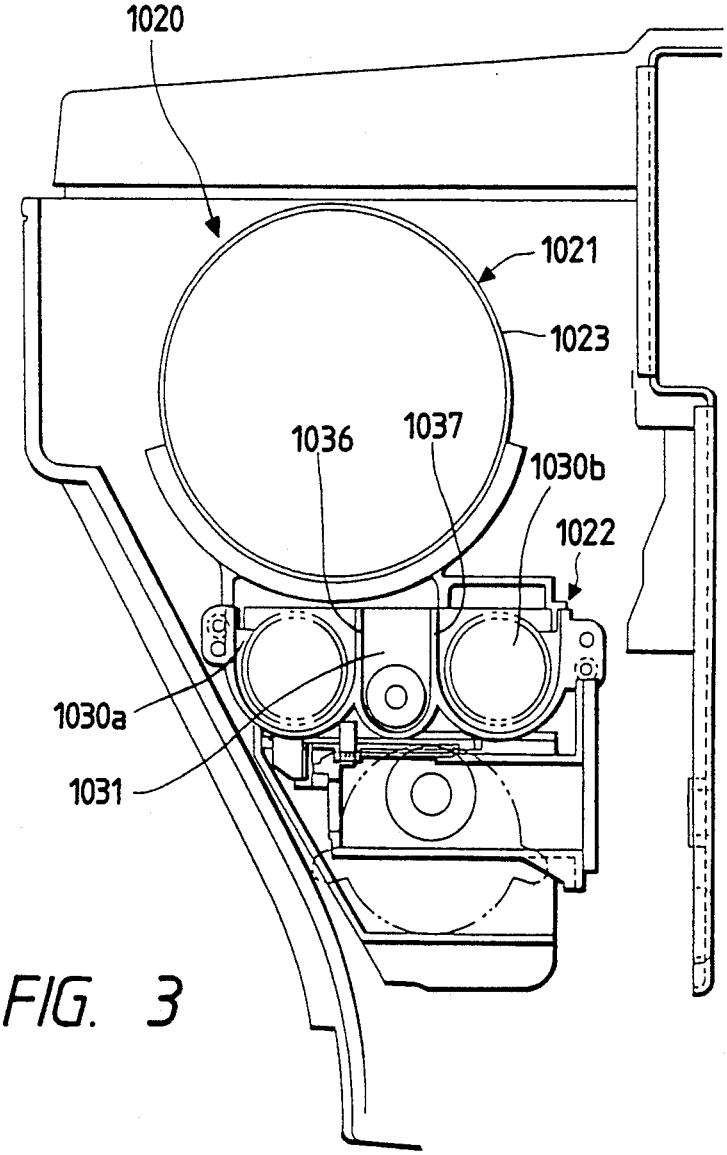
FIG. 3

FIG. 14
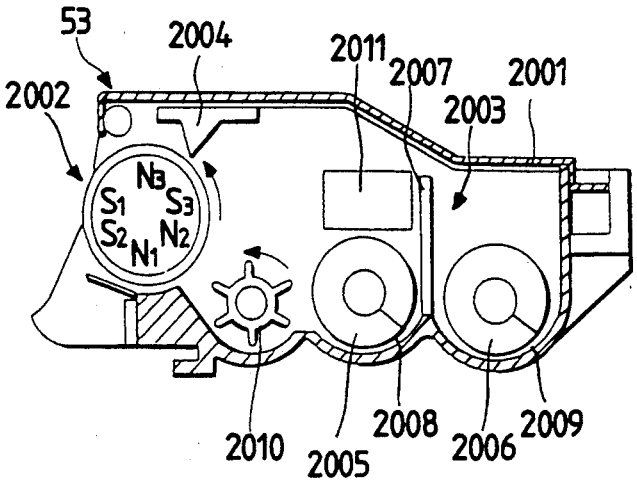
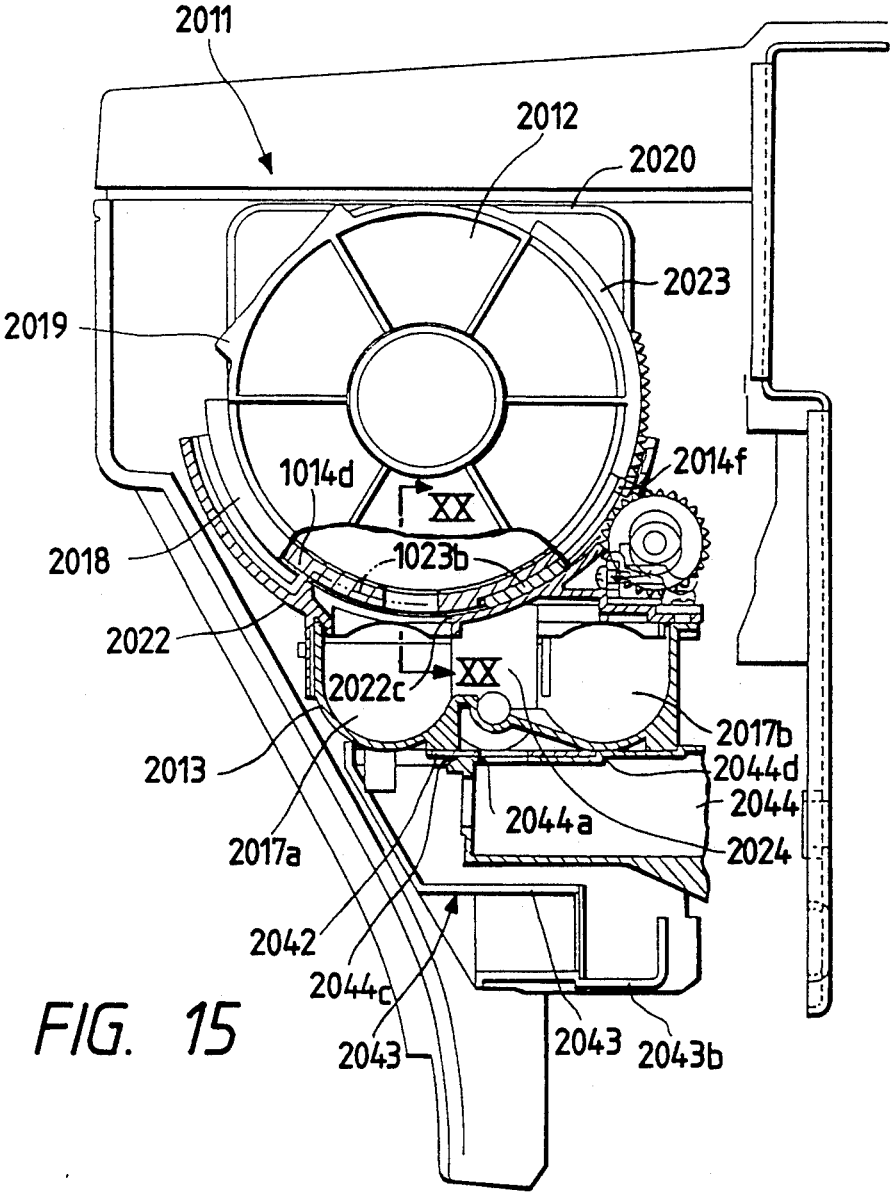
FIG. 15

IMAGE PROCESSING APPARATUS

BACKGROUND OF THE INVENTION

Field of the Invention

The present invention relates to a toner supply device with a toner-contained cartridge of the throwaway type, which is for supplying toner to a developing unit of an image forming apparatus, and more particularly to a toner supply device with a throwaway type cartridge having a spiral agitator.

The present invention also relates to a reserve tank in a toner dispensing section for supplying toner to a developing unit.

Additionally, the present invention relates to an empty detector of an image forming apparatus with a reserve tank which receives toner from a cartridge used being loaded to the apparatus, and more particularly to an empty detector for an image forming apparatus, which detects an empty condition of a reserve tank.

In a conventional toner supply device for supplying toner to a developing unit of a copying machine, a toner box is installed in a main body of a copying machine. Toner is supplied from the toner box to the developing unit by means of an auger. When toner is used up in the toner box, the toner box is pulled out to a toner supply position, and toner contained in a spare toner bottle is supplied to the toner box. The kinds of toner supplied are different for the types of the copying machines used. This makes servicing of the toner supply difficult and complicated. The toner supply servicing is usually done by a serviceman, for this reason.

The user must call a serviceman every time toner is used up. The user often encounters a situation where the user calls the serviceman, but he cannot quickly come for the toner supply service. The user then cannot use the copying machine until the serviceman arrives. This is very inconvenient for users.

In the toner supply servicing, the user often experiences that leaked toner drops fall on the floor on which the machine is located, or stick to clothes. Use of a cartridge filled with toner, in place of the conventional toner bottle, has been proposed. In the machine using the cartridge, when loaded to the machine, the cartridge is set to the toner box, and a cap is removed from the cartridge. When the cartridge is empty, the empty or old cartridge is removed and replaced by a new one. This proposal successfully solves the problem of soiling with the leaked toner. The toner supply servicing for the machine using the cartridge requires at least three actions; 1) to set the cartridge to the toner box, 2) to supply toner, and 3) to remove the cartridge. This is troublesome work. The serviceman call is still needed for the toner supply work. The problem as state above still remains unsolved.

If the user, layman, tries to replace the old toner cartridge with a new one, he will frequently make mistakes in the toner supply servicing. For example, a toner incompatible with the copying machine under use or an imitative toner may be set to the toner box of the machine.

Also in a case that the copying machine is left not used for a long time and accordingly toner is left in an immovable condition for a long time, the toner will make into lumps within the cartridge. The toner lumps may cause toner blocking.

SUMMARY OF THE INVENTION

The present invention has been made in view of the above circumstances and has an object to provide a toner supply device for an image forming apparatus which solves the problem of the toner blocking taking place within a cartridge.

According to a first aspect of the invention, there is provided a toner supply device for an image forming apparatus, comprising a tubular toner cartridge, which is removably set to the toner supply device and used while being set to the toner supply device, and a spiral agitator disposed within the toner cartridge. When the spiral agitator is rotated, toner is transferred to a toner supply port. Accordingly, the toner blocking is prevented and the toner is stably and reliably transferred to the port. The resultant picture is stable and excellent in picture quality.

In the toner supply device of the invention, the toner supply port is formed at one end of the main body, and the end of the spiral agitator, which is closer to the toner supply port, is free, and supported by the tubular main body (only rotation of it is allowed). Generally, toner blocking tends to occur particularly in the vicinity of the toner supply port. With the free end of the spiral agitator, which is closer to the toner supply port, the toner blocking is effectively removed.

Also in the toner supply device, a drive force transmission shaft for transmitting a rotating drive force from the drive means is provided at the end of the spiral agitator, which is opposite to the end closer to the toner supply port, in a state that the shaft is integral with the spiral agitator. With this structure, when the spiral agitator is rotated so as to transfer toner toward the toner supply port, and load by the toner is locally applied to the spiral agitator, the spiral agitator becomes small in diameter. Therefore, such a situation will never occur that the spiral agitator touches the inner wall of the tubular main body of the cartridge, and is locked. In addition, good dispensing of toner is secured. One piece construction of the drive force transmission shaft and the spiral agitator leads to a decrease in the number of parts and components, and easy manufacturing and reduction of cost to manufacture.

Additionally in the toner supply device, a crushing member for crushing lumps of toner is provided near the toner supply port. Provision of the toner crushing member prevents the toner blocking in the vicinity of the toner supply port, and hence results in a stable toner dispensing operation.

Another object of the invention is to provide a reserve tank for a toner dispensing section of an image forming apparatus, which provides a stable dispensing operation even if the apparatus uses the reserve tank as a medium component for the toner supply to the developing unit.

Yet another object of the invention is to provide a reserve tank for a toner dispensing section of an image forming apparatus which improves the manipulation in the toner supply work and protects the inside of the machine and the machine-located floor against the leaked toner.

A further object of the present invention is to provide a reserve tank for a toner dispensing section of an image forming apparatus which is free from the missetting of a toner incompatible with a copying machine under use or an imitative toner.

According to a second aspect of the invention, there is provided a reserve tank for a toner dispensing section of an image forming apparatus, comprising a toner container for containing toner supplied from a cartridge, and a toner supply section for receiving toner from the toner container and supplying the received toner to a developing unit. A spiral agitator for supplying toner to the toner supply section is provided in the toner container. An auger for transferring toner to the developing unit is disposed in the toner supply section. A toner transfer power of the spiral agitator is set to be larger than that of the auger.

Since the toner transfer power of the spiral agitator is larger than that of the auger, a toner pressure within the reserve tank is maintained substantially constant, stabilizing the dispensing operation.

The reserve tank may comprise a cover for covering the upper portion of a reserve tank. The cover includes holder means for holding the toner cartridge, an opening for leading toner from the toner cartridge into the reserve tank, and a shutter for opening and closing the opening in synchronism with the operation of setting the toner cartridge to the holder means.

The shutter prevents foreign material from entering the reserve tank through the opening. The shutter is automatically opened and closed when the cartridge is set, thereby providing easy operation of the shutter.

The shutter is locked at a predetermined position by a lock mechanism, and is unlocked in synchronism with the operation of setting the cartridge to the holder means, whereby the shutter is opened and closed.

Accordingly, the missupply of the incompatible toner and imitative toner as well is prevented.

The reserve tank may comprise a cover for covering the upper portion of a reserve tank. The cover includes holder means for holding the toner cartridge, positioning means for positioning the toner cartridge, and an opening for leading toner from the toner cartridge into the reserve tank. The cover serves as a toner receptacle, with the holder means being integral with the positioning means.

With the construction, the toner cartridge is positioned in place by the positioning means and held by the holder means when it is set. An exact and easy setting of the toner cartridge is realized.

The reserve tank may also comprise a cover for covering the upper portion of a reserve tank. The cover includes holder means for holding the toner cartridge, positioning means for positioning the toner cartridge, and an opening for leading toner from the toner cartridge into the reserve tank. The cover further may comprise a toner staying portion being formed near the opening of the cover.

Since the toner staying portion receives toner leaked from the reserve tank, the shutter can be smoothly opened and closed, and the toner will not be sputtered.

Also in the reserve tank, a cover member covering the lower side of the developing unit and the toner dispensing portion is integral with the reserve tank.

The cover member reliably receives the toner leaking from a gap between the developing unit and the toner dispensing portion. Accordingly, the inside of the machine, the floor, and the like will not be soiled by the leaked toner.

A further object of the invention is to provide an empty detector in use with an image forming apparatus for accurately and easily sensing an empty state of a reserve tank. An additional object of the invention is to provide an empty detecting method for accurately and readily detecting an empty state of a reserve tank.

According to a third aspect of the invention, there is provided an empty detector in use with an image forming apparatus, in which the empty sensor is disposed at such a position that, unsoiled by toner leaked from the toner cartridge, the sensor can detect, within the reserve tank, such an amount of toner left in the reserve tank as to allow the toner to be dispensed a prescribed number of times. Display means responds to an empty signal from the toner empty sensor to indicate that the reserve tank is empty. Accordingly, the empty sensor accurately senses the amount of left toner, while being unsoiled by the leaked toner. Even after the empty state of the reserve tank is detected, the developing operation may be performed the prescribed number of times.

In the empty detector, a spiral agitator for transferring toner is disposed within the reserve tank, and the spiral agitator is provided with a cleaning member, which cleans the sensor surface of the empty sensor while moving across the empty sensor in a non-contact manner. With provision of the cleaning member, the sensor surface is cleaned, ensuring an high accuracy of sensing the remaining toner. With no contact of the cleaning member with the sensor surface, the sensor surface is little worn. Use of a plurality of cleaning members provides a more efficient cleaning of the sensor surfaces of different surface areas. Use of the cleaning member formed of a wire made of resilient material improves a further reliable cleaning of the sensor surface. If the diameter of the wire ranges between 0.1 mm and 0.5 mm, an improved cleaning operation is obtained.

The empty detector may comprise a display-removal switch for removing a display visually presenting a message of an empty state of the reserve tank by the display means, the switch operating in synchronism with the operations of setting and removing the toner cartridge. With use of the display removal switch, when a new toner cartridge is set in a prescribed location, the display of the empty tank is automatically removed. In other words, the display can be reliably removed without any special manipulation.

In the empty detector, the display-removal switch may be a two-contact switch alternately operating when the toner cartridge is set and removed. In this case, nonvolatile memory means is used for storing an on-state of the two-contact switch. Means is further provided for detecting a state change of the on-state of the two-contact switch according to the content of the memory means, and for removing the tank empty display.

According to a fourth aspect of the invention, there is provided an empty detecting method which puts into a reserve tank the toner supplied from a toner cartridge, which is used being set to the reserve tank, feeds the toner from the reserve tank to a developing unit, detects, by means of an empty sensor, such an amount of toner left in the reserve tank as to allow the toner to be dispensed a prescribed number of times, and displays an empty state of the reserve tank by display means. In the method, a display-removal switch detects the completion of setting the toner cartridge, and produces a display-removal signal, and the tank-empty display by the display means is removed in response to the display-removal signal.

In the empty detecting method, after the tank empty display by the display means is removed on the basis of a removal signal from the display removal signal, the empty sensor is inhibited from sensing the empty state while the toner is dispensed a prescribed number of times. Therefore, the erroneous sensing by the empty sensor will not take place.

Also in the empty detecting method, the number of black dispensing operations is counted from an instant that the display removal switch outputs a signal, and an amount of the toner left in the toner cartridge is predicted on the basis of the count.

Additionally, in the empty detecting method, a value of a count representing the number of the black dispensing operations is reset by the display-removal signal. Accordingly, an amount of the toner left in the toner cartridge can be predicted further accurately.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

FIG. 2 is an enlarged sectional view showing developing means of the color copying machine;

FIG. 3 is a cross sectional view showing a toner supply device in the color copying machine;

FIG. 5(*b*) is a bottom view showing the toner cartridge;

FIG. 5(*c*) is a side view of the toner cartridge as viewed from the right side;

FIG. 5(*d*) is a sectional view taken on line Vd—Vd in FIG. 5(*a*);

FIG. 14 is an enlarged sectional view showing developing means of the color copying machine;

FIG. 15 is a cross sectional view showing a toner dispensing portion in the color copying machine;

FIG. 17(*b*) is a bottom view showing the toner dispensing portion;

FIG. 17(*c*) is a side view of the toner dispensing portion as viewed from the right side;

FIG. 17(*d*) is a sectional view as viewed in the longitudinal direction;

FIG. 17(*e*) is a sectional view taken on line VE—VE in FIG. 17(*e*);

FIG. 17(*f*) is a perspective view showing the toner dispensing portion;

FIG. 18(*b*) is a bottom view showing the cover;

FIG. 18(*c*) is a side view of the cover as viewed from the right side;

FIG. 18(*d*) is a sectional view taken on line XVIIID—XVIIID in FIG. 18(*a*);

FIG. 18(*e*) is a enlarged view of a portion A in FIG. 18(*d*);

FIG. 18(*f*) is a sectional view taken on line XVIIIF—XVIIIF in FIG. 18(*a*);

FIG. 19(*b*) is a front view showing the shutter;

FIG. 19(*c*) is a side view of the shutter as viewed from the right side;

FIG. 20(*b*) is an enlarge sectional view showing a portion B in FIG. 20(*a*);

FIG. 25(*b*) is a partial sectional view of the toner supply device;

FIG. 26(*b*) is a diagram showing an on state of a second switch;

FIG. 27(*b*) is a side view of the cleaning member;

FIGS. 27(*c*) and 27(*d*) are diagrams showing how to maintain a prescribed gap between the cleaning member and an empty sensor.

DETAILED DESCRIPTION OF THE PREFERRED EMBODIMENTS

The preferred embodiments of the present invention will be described in detail with reference to the accompanying drawings.

Figure 1:
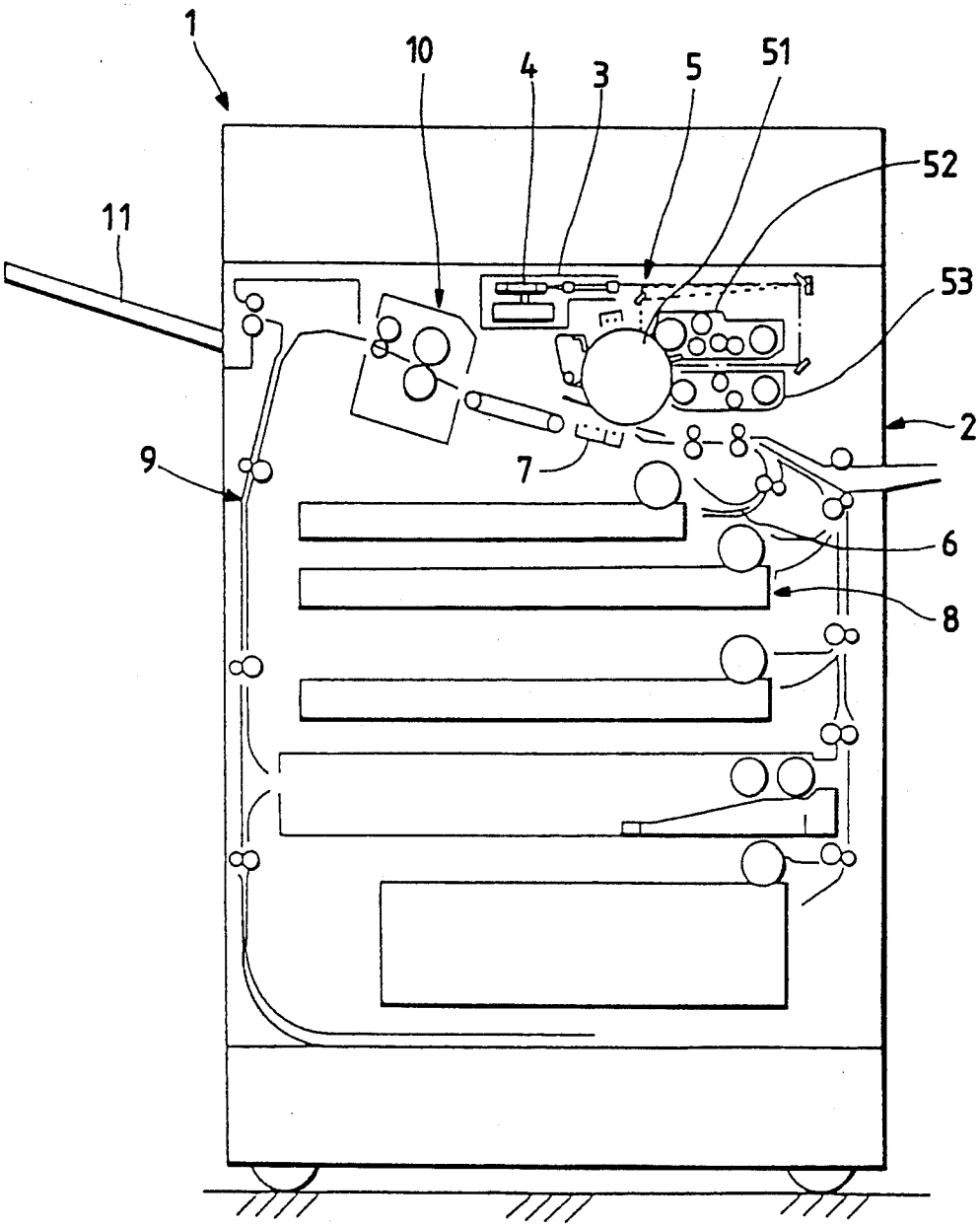
FIG. 1 is a sectional view showing a color copying machine to which a first embodiment of the invention is applied.

FIG. 1 is a sectional view showing a color copying machine to which a first embodiment of the invention is applied.

As shown in FIG. 1, a color copying machine 1 comprises a main body 2, a platen 3, provided on the top surface of the main body 2, on which an original document is placed, an image reader 4, provided under the platen 3, for reading picture information on the original, an image forming unit 5 for forming a prescribed image according to signals from the image reader 4, a transfer unit 7 for transferring an image formed by the image forming unit 5 onto paper 6 as image transfer medium, a paper supply section 8 for supplying the paper 6, and a paper transport section 9 for transporting paper 6.

The image forming unit 5 includes a photoreceptor 51, first and second developing means 52 and 53 located adjacent to the photoreceptor 51.

The first developing means 52 is a developing unit with a color, two-component developer. The second developing means 53 is a developing unit with a black, two-component developer, and develops a second latent image by the magnetic brush developing method based on the FX micro-toning system.

The developing means 52 and 53 are moved to and from the photoreceptor 51 by retract mechanisms, respectively.

The second developing means 53 to which a toner cartridge in a toner supply device according to the present embodiment is attached, will be described in more detail.

With the construction as shown in FIG. 2, the second developing means 53 develops a second latent image, which is formed on the photoreceptor 51, by the magnetic brush developing method based on the FX micro-toning system. The developing means 53 generally includes a developing roll (developer bearing member) 1002, a developer agitating means 1003, and a trimmer plate (trimmer) 1004. The developing roll 1002 is located at an end portion of a housing 1001, the outer spherical surface of which is partially exposed to the outside of the housing, through an opening. The developer agitating means 1003 is disposed on the rear side of the developing roll 1002 within the housing 1001. The trimmer plate 1004 is mounted on the top plate of the housing 1001, which is above the developing roll 1002, and regulates the bristle height of the magnetic brush of the developer distributed on the developing roll 1002.

Tracking rolls (not shown) are rotatably provided on both sides of the developing roll 1002. The tracking rolls are brought into contact with the photoreceptor 51, to maintain a fixed width of a gap between the developing roll 1002 and the photoreceptor 51.

The agitating means 1003 includes first and second augers 1007 and 1008, which are parallel to the developing roll 1002 in the axial direction, and a partitioning plate 1009, erected in the housing 1001, for partitioning the two augers one from the other. The augers 1007 and 1008 are rotated in such directions that the developer transfer directions are opposite to each other. At both end portions of the partitioning wall, openings are formed through which a region (referred to as a first agitating path 1010) where the first auger 1007 is disposed communicates with a region (referred to as a second agitating path 1011) where the second auger 1008 is disposed. Through the openings, the developer circulates through a route; first agitating path 1010 → second agitating path 1011 → first agitating path 1010.

A paddle wheel 1012 with blades, which longitudinally extend in the axial direction, is disposed between the developing roll 1002 and the agitating means 1003. With rotation of the paddle wheel, the developer separated from the developing roller 1002 is forcibly transferred toward the agitating means 1003, while the developer mixed and agitated by the agitating means 1003 is continuously supplied to the developing roll 1002.

Figure 4:
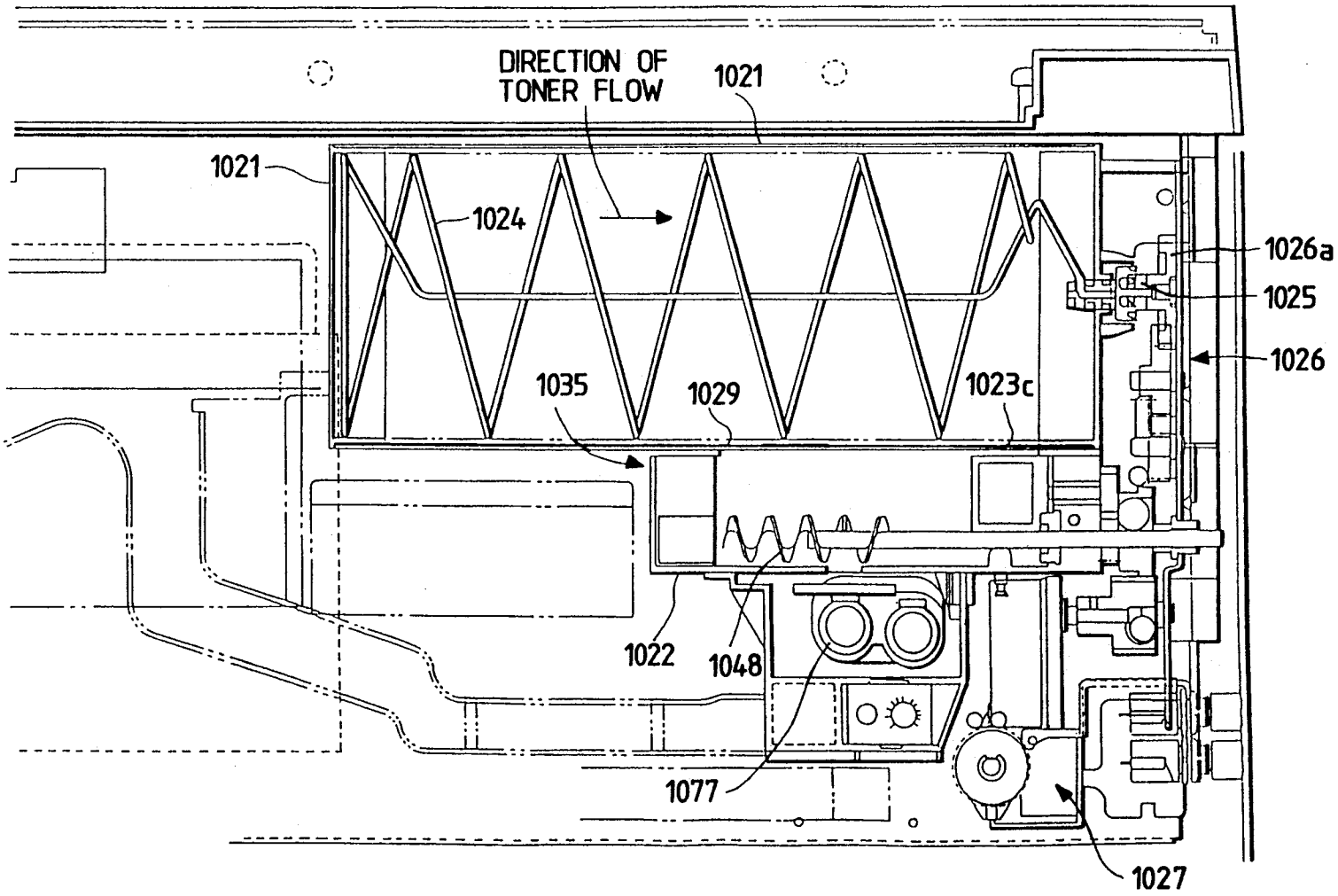
FIG. 4 is a longitudinal sectional view showing the toner supply device.
Figure 5A:
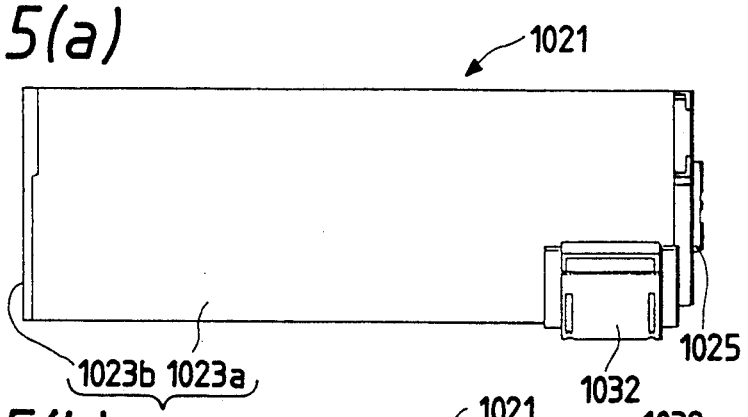
FIG. 5(*a*) is a front view showing an example of a toner cartridge in the color copying machine.
Figure 5B:
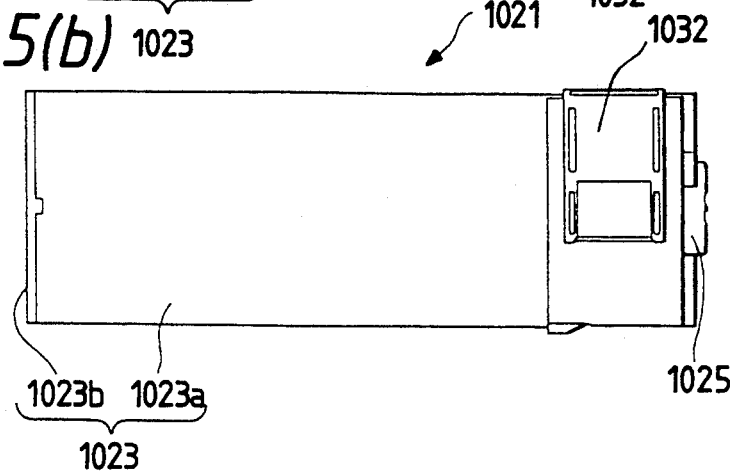
Figure 5C:
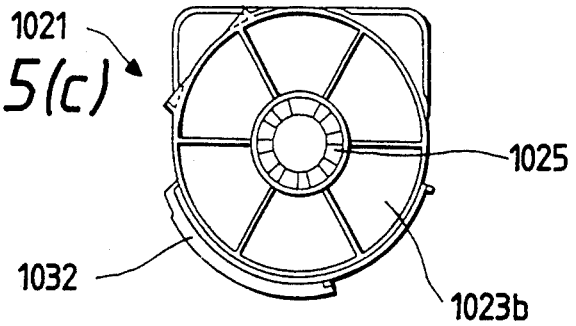
Figure 5D:
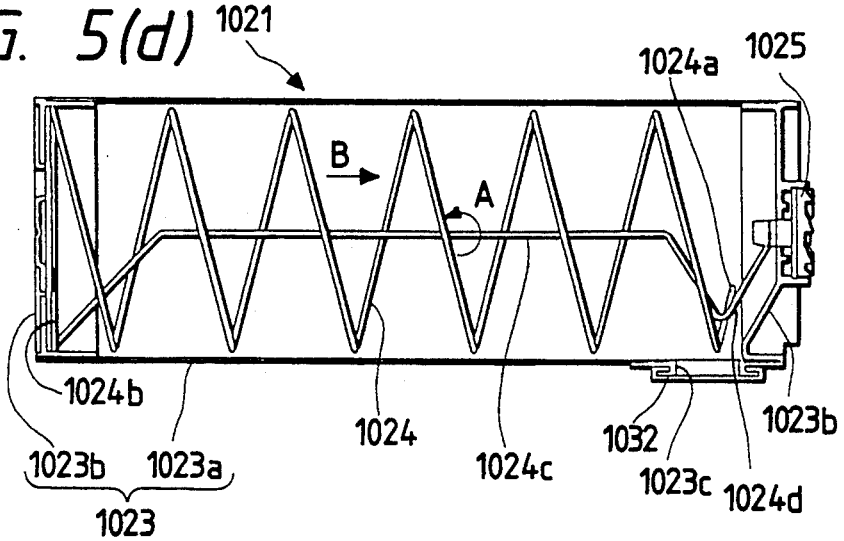

A toner supply device 1020, disposed above the first auger 1007 within the housing 1001, includes a toner cartridge 1021 filed with toner, and a reserve tank 1022 disposed under the toner cartridge 1021, as shown in FIGS. 3 and 4.

As shown in FIGS. 5(*a*) through 5(*d*), the cartridge 1021 comprises a case body 1023, a spiral agitator 1024, and a coupling 1025. The case body 1023 includes a tubular portion 1023*a* made of paper, and resin made end walls 1023*b* closing both ends of the tubular portion. The spiral agitator 1024 consists of metal wire spirally coiled. The coupling 1025 is coupled with the spiral agitator 1024. The tubular portion 1023*a*, when made of paper, is advantageous in several points. For example, since it can be cut, it is cut to adjust its length so as to be adaptable for different types of machines. Since the paper is cheap, cost to manufacture the cartridge 1021 may be considerably reduced.

A toner supply port 1023*c* for supplying toner to the reserve tank 1022 is formed in the tubular portion 1023*a* at one end portion of the case body 1023. The toner supply port 1023*c* opens to a toner container 1030*a* as one of the toner containers of a tank portion 1030 of the reserve tank 1022.

The end 1024*a* of the spiral agitator 1024, which is closer to the toner supply port, is free. The other end 1024*b*, opposite to the end closer to the toner supply port, is rotatably supported by the inner surface of the end wall 1023*b*. A drive force transmission shaft 1024*c* is continuous to the end 1024*b*. The shaft 1024*c* extends along the axis of revolution towards the toner supply port 1023*c*. The distal end of the shaft is coupled with the coupling 1025, which is rotatably mounted on the center portion of the right-side end wall 1023*b*. A toner crushing member 1024*d*, shaped like a triangle protrusion, is formed at the portion of the drive force transmission shaft 1024*c*, which faces the toner supply port 1023*c*. Thus, the spiral agitator 1024 is cantilevered.

As shown in FIGS. 5(*a*), 5(*b*), and 5(*d*), a shutter 1032, mounted on the cartridge 1021, is circumferentially slidable. The shutter closes the toner supply port 1023*c* when the cartridge is not set to the toner supply device. A flexible sealing means (not shown) for closing the toner supply port 1023*c* is stuck on the case body 1023. The sealing means is fixed at one end to the shutter 1032. When the shutter is circumferentially slid, the sealing means is peeled off to open the toner supply port 1023*c*.

As shown in FIG. 4, the toner cartridge 1021 is removably set at a preset position in a cartridge set portion 1035 provided in the machine main body 2. Specifically, in FIG. 4, the toner cartridge 1021 is axially inserted toward the cartridge set portion 1035. When the cartridge 1021 reaches a preset position, the cartridge is turned at a prescribed angle. Then, the cartridge 1021 is locked, and set to the cartridge set portion 1035. In this case, when the cartridge 1021 reaches a preset position, a part of the cartridge 1021 engages with an engaging portion (not shown) of the reserve tank 1022, to prohibit the rotation of the shutter 1032. At this time, the shutter 1032 circumferentially slides with respect to the case body 1023, so that the sealing means is peeled off and the toner supply port 1023*c* opens. That is, when the cartridge 1021 is locked and fixedly set to the cartridge set portion 1035, the toner supply port 1023*c* is directed downwardly to open toward the reserve tank 1022.

When the cartridge 1021 is set to the cartridge set portion 1035, the coupling 1025 of the cartridge 1021 is coupled with another coupling 1025 mounted on a gear 1026*a* of a power transmission mechanism 1026, which is provided in the machine main body 2. A rotating drive force generated by drive means 1027, such as a motor, which is transmitted through the power transmission mechanism 1026, is transmitted to the end of the spiral agitator 1024, which is opposite to the toner supply port 1023*c*. Accordingly, the spiral agitator 1024 receives the drive force from the left side in FIG. 5(*d*). The spiral agitator 1024 rotates in the direction of an arrow A, and toner flows in the direction of an arrow B, viz., toward the toner supply port 1023*c*, and enters the reserve tank 1022 through the toner supply port 1023*c*.

Since the toner thus flows, the toner will not form lumps. The rotation of the toner crushing member 1024*d* additionally contributes to minimization of the lumping of the toner. If the toner lumps, the rotating crushing member crushes the lumps. The rotating direction A of the spiral agitator 1024 is selected so that when load is applied to the spiral agitator 1024, its diameter will reduce. Accordingly, the spiral agitator 1024 comes in contact with the inner circumferential surface of the tubular portion 1023*a* to be locked. This prevents disengagement of the gear 1026*a* in the power transmission mechanism 1026.

Figure 6:
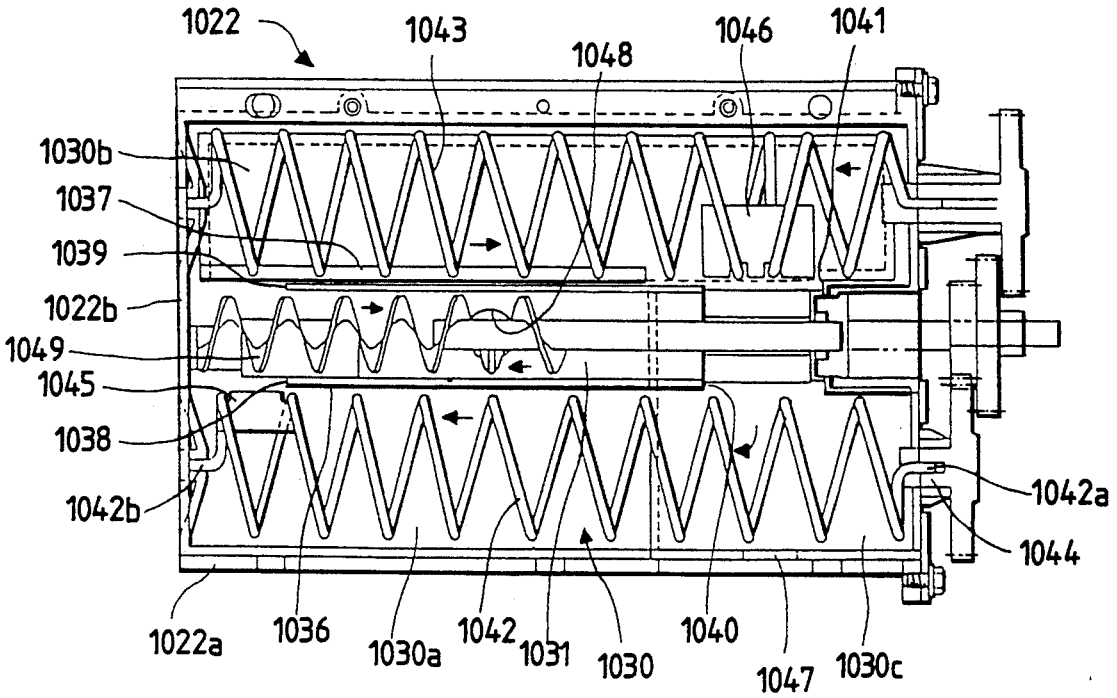
FIG. 6 is a sectional view of a reserve tank in the color copying machine.

As illustrated in FIGS. 3 and 6, the reserve tank 1022 includes a tank section 1030 consisting of toner containers 1030*a* and 1030*b*, and a toner supply section 1031, disposed between the containers 1030*a* and 1030*b*, for supplying toner to the developing means 53. Partition walls 1036 and 1037 are provided partitioning the toner containers 1030*a* and 1030*b*, and the toner supply section 1031. The partition walls 1036 and 1037 extend toward the left wall 1022*b* of the body 1022*a* of the reserve tank 1022, but fail to reach the wall to form openings 1038 and 1039 between the left wall 1022*b* and the left ends of the partition walls 1036 and 1037. The partition walls 1036 and 1037 have respectively openings 1040 and 1041 at locations deviated from the right ends to the left. Through the openings 1038, 1039, 1040, and 1041, the toner containers 1030*a*, 1030*b*, an the toner supply section 1031 communicate with one another.

Spiral agitators 1042 and 1043 formed of spirally coiled metal lines, for example, wires are disposed parallel to each other within the toner containers 1030*a* and 1030*b*. The right end 1042*a* of the spiral agitator 1042 is coupled with a gear shaft 1044, while the left end 1042*b* is rotatably supported by the left wall 1022*b*. The spiral agitator 1042 is coiled unidirectional. A blade 1045 is mounted on the portion of the spiral agitator 1042, which faces the opening 1038. The other spiral agitator 1043 is also supported at both ends in a similar way. In the left portion of the spiral agitator 1043 with respect to the opening 1041, the spiral agitator 1043 is coiled in the same direction as the coiled direction of the spiral agitator 1042, but in the right portion, it is coiled in the direction opposite to the former. A blade 1046 is mounted to the portion where the coiling direction is changed, viz., the portion facing the opening 1041.

A portion of the toner container 1030*a* on the right side of the opening 1040 serves as a toner introducing portion 1030*c*. An empty sensor 1047 is provided on the side wall of the body 1022*a* at a location relatively to the left from the position facing the toner supply port 1023*c* of the cartridge 1021. The empty sensor 1047 is provided for sensing presence or absence of toner within the cartridge 1021.

A toner supply hole 1048 for supplying toner to the developing means 53 is provided at a preset location on the bottom of the toner supply section 1031. Disposed within the toner supply section 1031 is an auger 1049 arranged in parallel to two spiral agitators 1042 and 1043. The auger is also rotatably supported by the body 1022*a* as the spiral agitators 1042 and 1043. The coiling directions of the coiled blade of the auger 1049 are opposite to each other with respect to the supply hole 1048.

In connection with the reserve tank 1022 thus constructed, when the cartridge 1021 is set to the cartridge set portion 1035, the shutter 1032 slides and the toner supply port 1023*c* automatically opens concurrently with the slide. Then, the toner is introduced from the cartridge 1021 to the toner introducing portion 1030*c* in the reserve tank 1022, through the toner supply port 1023*c*. With rotation of the spiral agitator 1042, the introduced toner is transferred to the left while at the same time is sensed by the empty sensor 1047. While the toner is transferred to the left, new toner is introduced into the toner introducing portion 1030*c*, from the cartridge 1021. When the toner reaches the left end of the toner container 1030*a*, the toner is transferred, with the blade 1045, toward the toner supply section 1031, through the opening 1038. A part of the toner transferred to the toner supply section 1031 is transferred toward the supply hole 1048 by means of the auger 1049. The toner is further transferred through the toner supply hole 1048 toward the developing means 53. It is noted here that the toner, after passing the supply hole 1048, is returned to the supply hole 1048, with the blade of the auger of which the coiled direction is reversed, as recalled. Accordingly, the toner is reliably transferred toward the developing means 53, through the supply hole 1048. The remaining part of the toner transferred to the toner supply portion 1031 is pushed forwardly by new incoming toner transferred by the blade 1045, and flows through the opening 1039 to the toner container 1030*b*. In the toner container 1030*b*, the toner is transferred toward the right opening 1041 by means of the spiral agitator 1043. The toner reaches the opening 1041 and is transferred, by the blade 1046, to the toner container 1030*a* openings 1041 and 1040. The toner, if passing the opening 1041, is returned to the opening 1041 by the spiral agitator 1043 reversely coiled. The toner, when entering the toner container 1030*a*, is transferred again to the left by the spiral agitator 1042. In this case, the toner is reliably transferred to the left by the spiral agitator 1042, so that the toner coming through the opening 1040 will not be transferred to the left or toward the toner introducing portion 1030*c*. Consequently, only the toner supplied from the cartridge 1041 is introduced into the toner introducing portion 1030*c*.

In this way, a prescribed amount of toner within the reserve tank 1022 is transferred from the supply hole 1048 to the developing means 53, while the remaining toner circulates between the toner containers 1030*a* and 1030*b*. The toner circulation prevents the toner from lumping within the containers 1030*a* and 1030*b*.

The volumes of the toner containers 1030*a* and 1030*b* are selected such that 2000 to 3000 number of copies can be made till a new cartridge is set after the cartridge 1021 is empty.

Figure 7:
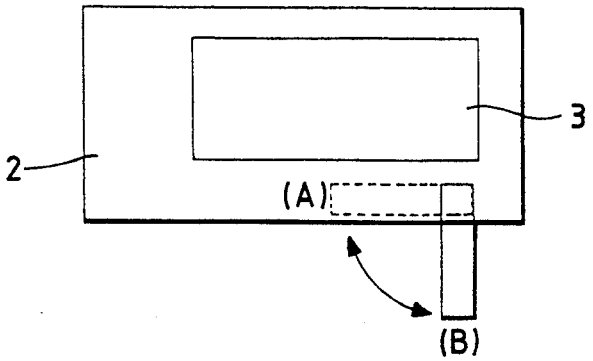
FIG. 7 is a diagram showing the setting of a toner cartridge.

As shown in FIG. 7, a dispenser unit, supported by the main body 2 of the copying machine, is swung between two positions A and B. The dispenser unit incorporates the cartridge 1021, cartridge set portion 1035, reserve tank 1022, power transmission mechanism 1026, and motor drive means 1027. In the position A as indicated by a solid line and extended laterally in the main body 2, the cartridge 1021 is set and used. In the position as indicated by a two-dot chain line and extended vertically in the main body 2 and located outside the main body, the cartridge 1021 is replaced with a new one. For replacement of the cartridge, the dispenser unit is turned to the replacing position B. An old cartridge 1021 is removed, and a new cartridge is set in the cartridge set portion 1035. Thereafter, the dispenser unit is turned to the position A and fixed thereat.

FIGS. 8 through 12 are sectional views showing other embodiments of the present invention. In those figures, like reference symbols are used for designating like or equivalent portions in the figures which were referred to in the description of the first embodiment.

Figure 8:
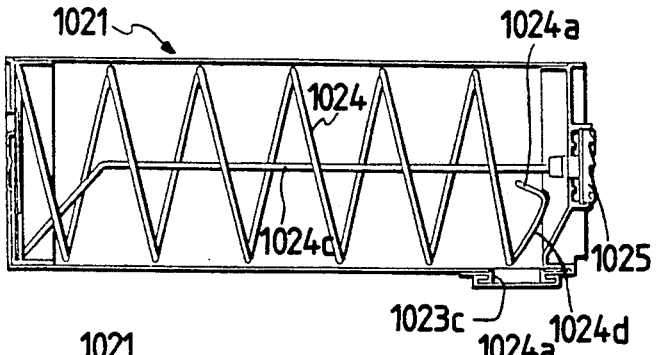
FIGS. 8 through 12 are diagrams showing a second embodiment of the invention.

In the embodiment of FIG. 8, the toner crushing member 1024*d* is provided at the free end 1024*a* of the spiral agitator 1024, which faces the toner supply port 1023*c*. With rotation of the spiral agitator 1024, the toner crushing member 1024*d* also rotates, so that the toner will not lump and the lump, if lumped, is crushed.

Figure 9:
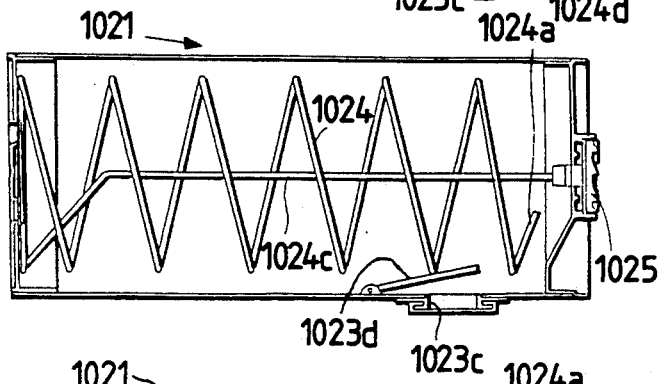

In the embodiment of FIG. 9, the toner crushing member 1023*d* is vertically movably provided in the vicinity of the toner supply port 1023*c* of the bottom of the tubular portion 1023*a*. The toner crushing member 1023*d* is constantly biased upwardly by means of energizing means, such as a spring. When the spiral agitator 1024 comes in contact with it, it is pressed down. With rotation of the spiral agitator 1024, a contact of the toner crushing member 1023*d* with the spiral agitator 1024 moves to the right as viewed in the drawing. Accordingly, the tone crushing member 1023*d* rotates counterclockwise. When the contact of the toner crushing member 1023*d* with the spiral agitator 1024 further moves to the right, the spiral agitator 1024 slips out of the toner crushing member 1023*d*, and is sprung upward by means of the energizing means. At this time, toner lumps are crushed near the toner supply port 1023*c*.

Figure 10:
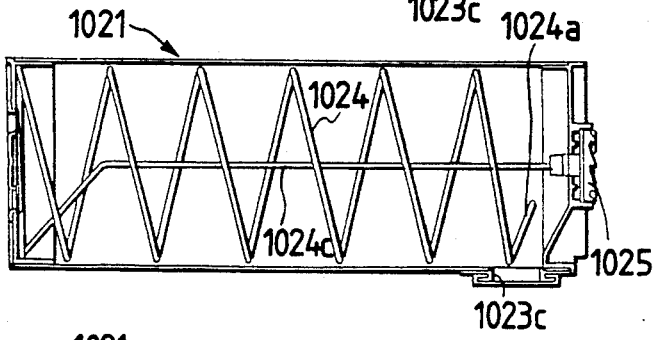
Figure 11:
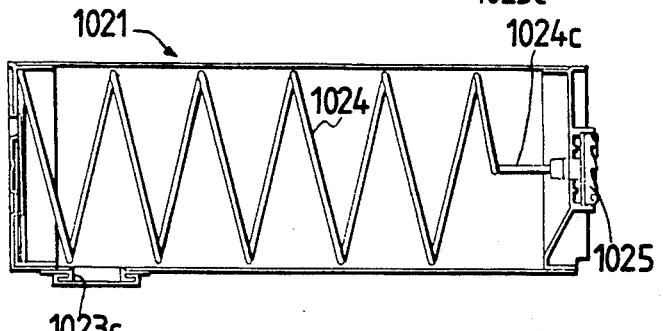
Figure 12:
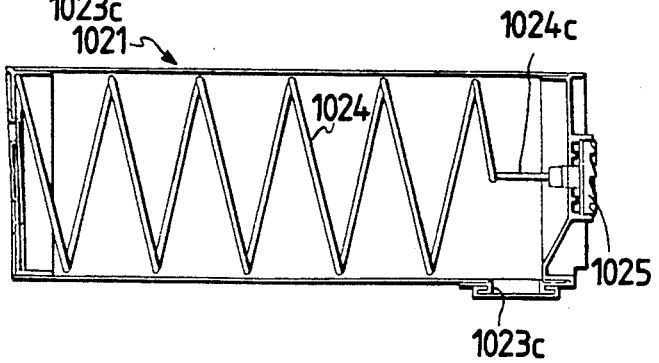

In the embodiment shown in FIG. 10, the toner crushing member is not used. In the embodiment of FIG. 11, the toner supply port 1023*c* and the coupling 1025 are distantly disposed at both ends of the cartridge, respectively. In the embodiments as mentioned above, the toner supply port 1023*c* and the coupling 1025 are provided on the same side of the cartridge. The power transmission shaft 1024*c* laterally extend within the spiral agitator 1024. In the instant embodiment, no power transmission shaft 1024*c* laterally extends within the spiral agitator 1024. The free end of the spiral agitator 1024 is positioned closer to the toner supply port 1023*c*. The embodiment shown in FIG. 12 is arranged such that the toner supply port 1023*c* and the coupling 1025 are both located on the same side. Also in this embodiment, no power transmission shaft 1024*c* laterally extends within the spiral agitator 1024. The free end of the spiral agitator 1024 and the toner supply port 1023*c* are oppositely disposed.

As seen from the foregoing description, in the present invention, the spiral agitator is provided within the toner cartridge. The provision of the spiral agitator prevents the blocking phenomenon of toner. Accordingly, a stable and reliable supply of toner is secured, providing a high quality of picture.

The end of the spiral agitator closer to the toner supply port is free. This prominent characteristic effectively suppresses the toner blocking which tends to occur in the vicinity of the toner supply port.

It is further noted that the rotating drive force of the drive means is applied from the portion opposite to the toner supply port of the spiral agitator. With the rotation, the diameter of the spiral agitator becomes small. Accordingly, it will not be locked, providing an excellent dispensing of the toner.

Additionally, it is noted that the toner crushing member is provided near the toner supply port. Use of the toner crushing member greatly contributes to the removal of the toner blocking near the toner supply port.

A third embodiment of the present invention will be described in detail with reference to the accompanying drawings.

Figure 13:
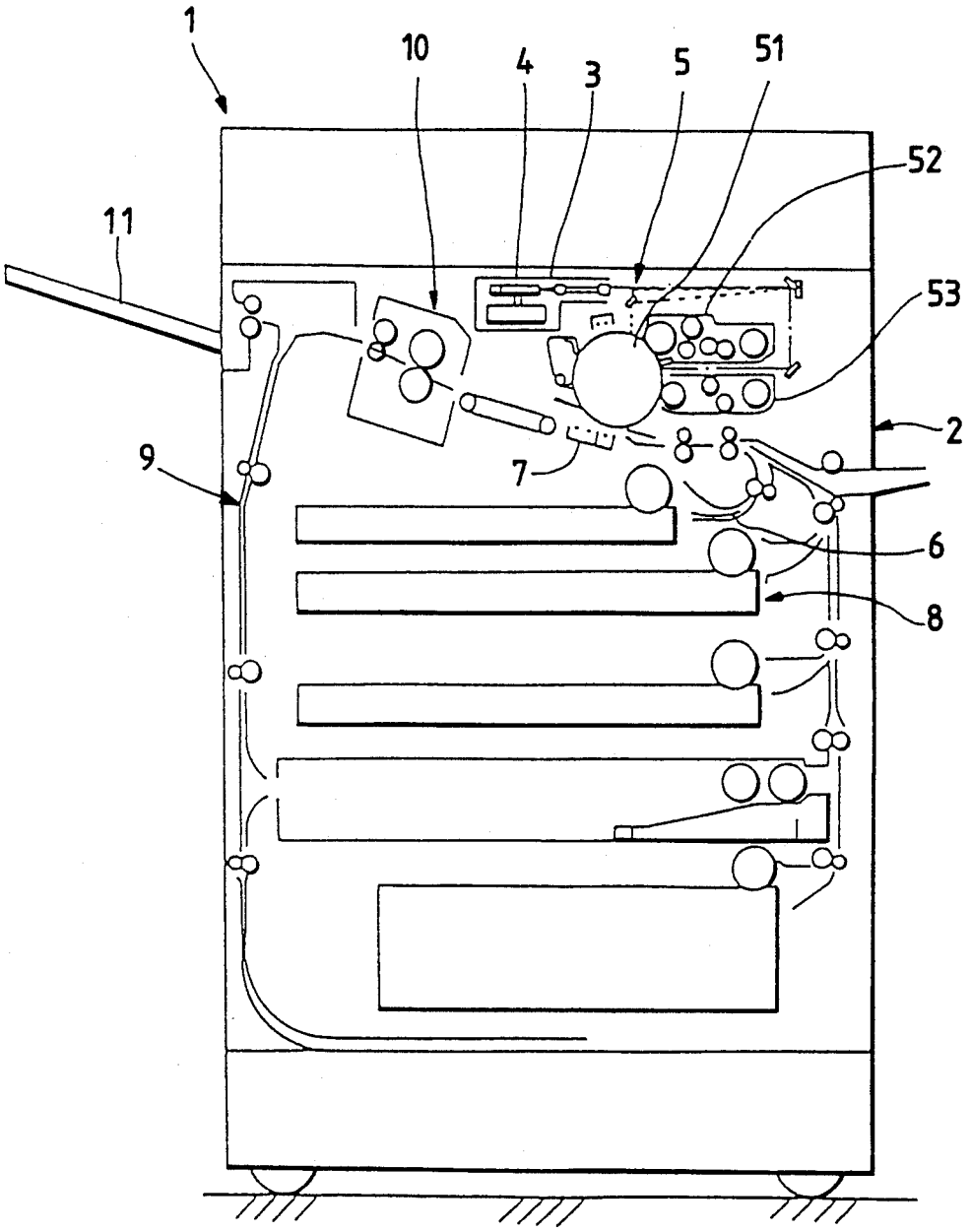
FIG. 13 is a sectional view showing a color copying machine to which a third embodiment of a toner cartridge according to the invention is applied.

FIG. 13 is a sectional view showing a color copying machine to which a third embodiment of the invention is applied.

As shown in FIG. 13, a color copying machine 1 comprises a main body 2, a platen 3, provided on the top surface of the main body 2, on which an original document is placed, an image reader 4, provided under the platen 3, for reading picture information on the original, an image forming unit 5 for forming a prescribed image according to signals from the image reader 4, a transfer unit 7 for transferring an image formed by the image forming unit 5 onto paper 6 as image transfer medium, a paper supply section 8 for supplying the paper 6, a paper transport section 9 for transporting paper 6, a fixing unit 10 for fixing a toner image that is transferred on paper by the image forming unit 5, and a discharge tray 11 for receiving paper bearing a toner image fused thereon.

The image forming unit 5 includes a photoreceptor 51, first and second developing means 52 and 53 located adjacent to the photoreceptor 51. The first developing means 52 is a developing unit with a color, two-component developer. The second developing means 53 is a developing unit with a black, two-component developer.

The developing means 52 and 53 are moved to and from the photoreceptor 51 by retract mechanisms (not shown), respectively.

The second developing means 53 to which a reserve tank in a toner dispense section according to the present embodiment, will be described in more detail.

With the construction as shown in FIG. 14, the second developing means 53 develops a second latent image, which is formed on the photoreceptor 51. The developing means 53 generally includes a developing roll (developer bearing member) 2002, a developer agitating means 2003, and a trimmer plate (trimmer) 2004. The developing roll 2002 is located at an end portion of a housing 2001, the outer spherical surface of which is partially exposed to the outside of the housing, through an opening. The developer agitating means 2003 is disposed on the rear side of the developing roll 2002 within the housing 2001. The trimmer plate 2004 is mounted on the top plate of the housing 2001, which is above the developing roll 2002, and regulates the bristle height of the magnetic brush of the developer distributed on the developing roll 2002.

Tracking rolls (not shown) are rotatably provided on both sides of the developing roll 2002. The tracking rolls are brought into contact with the photoreceptor 51, to maintain a fixed width of a gap between the developing roll 2002 and the photoreceptor 51.

The agitating means 2003 includes first and second augers 2005 and 2006, which are parallel to the developing roll 2002 in the axial direction, and a partitioning plate 2007, erected in the housing 2001, for partitioning the two augers one from the other. The augers 2005 and 2006 are rotated in such directions that the developer transfer directions are opposite to each other. At both end portions of the partitioning wall 2007, openings are formed through which a region (referred to as a first agitating path 2008) where the first auger 2005 is disposed communicates with a region (referred to as a second agitating path 2009) where the second auger 2009 is disposed. Through the openings, the developer circulates through a route; first agitating path 2008 → second agitating path 2009 → first agitating path 2008.

A paddle wheel 2010 with blades, which longitudinally extend in the axial direction, is disposed between the developing roll 2002 and the agitating means 2003. With rotation of the paddle wheel, the developer separated from the developing roller 2002 is forcibly transferred toward the agitating means 2003, while the developer mixed and agitated by the agitating means 2003 is continuously supplied to the developing roll 2002.

Figure 16:
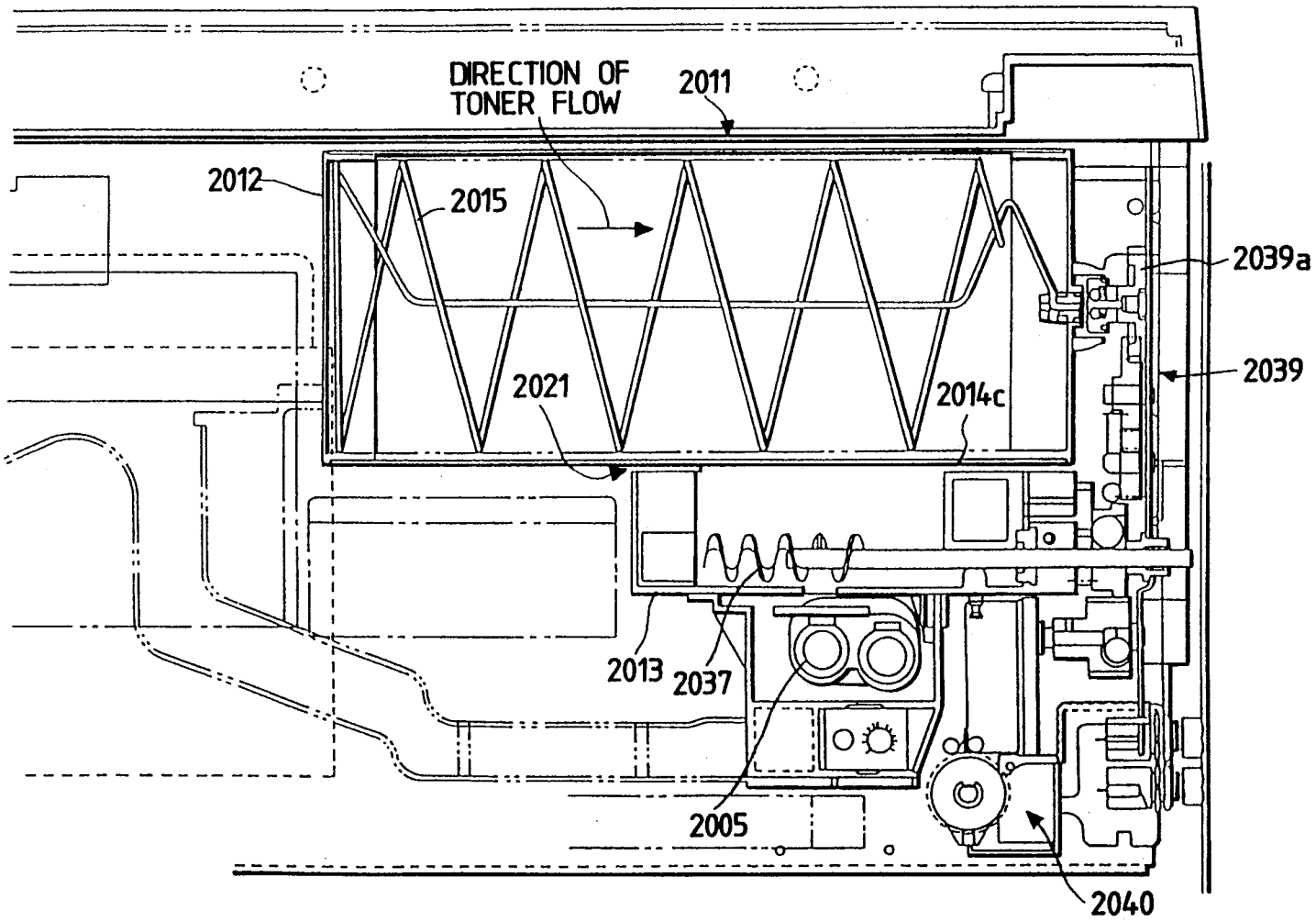
FIG. 16 is a longitudinal sectional view showing the toner dispensing portion.
Figure 17A:
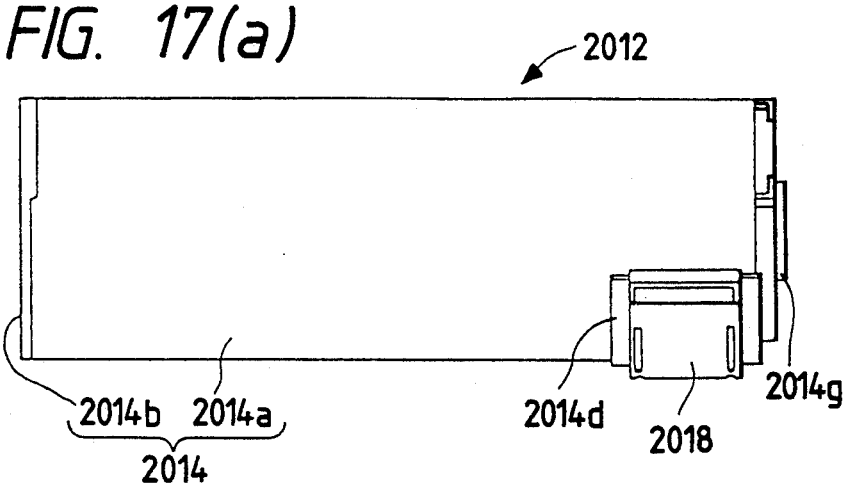
FIG. 17(*a*) is a front view showing an example of the toner dispensing portion in the color copying machine.
Figure 17B:
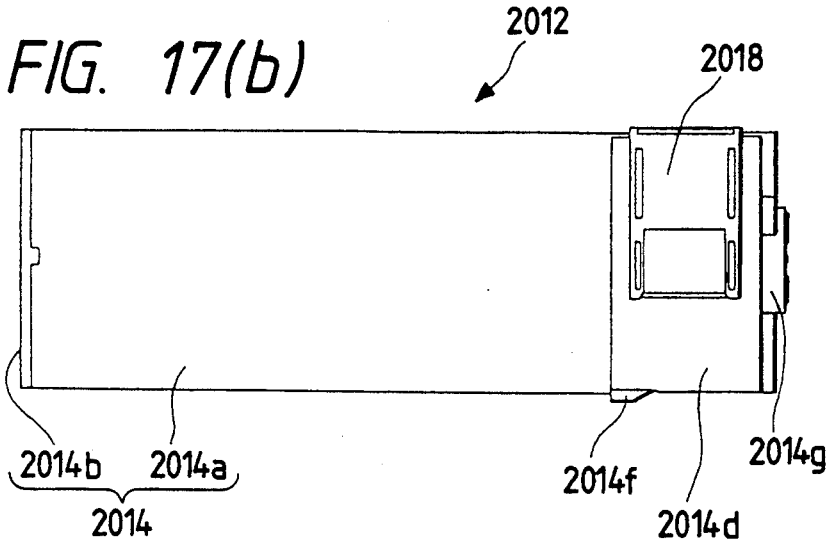
Figure 17C:
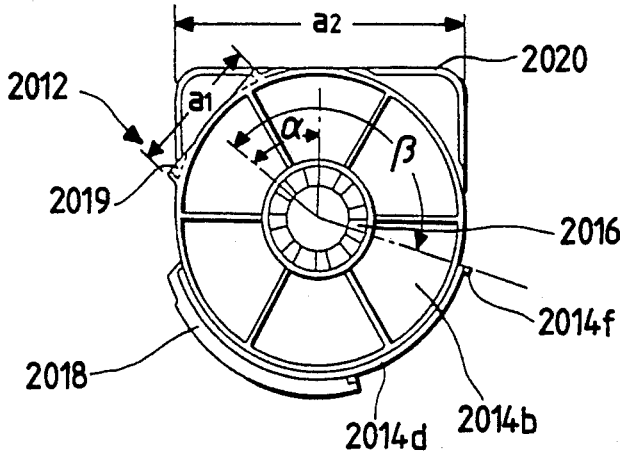
Figure 17D:
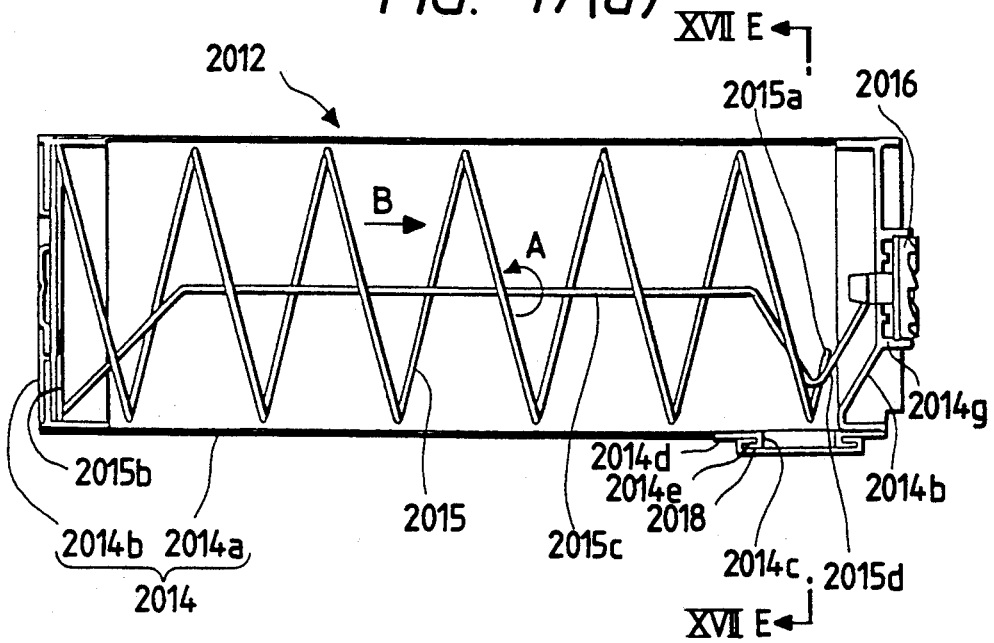
Figure 17E:
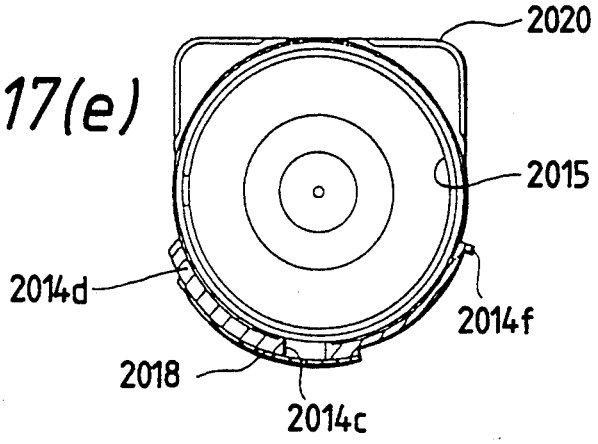
Figure 17F:
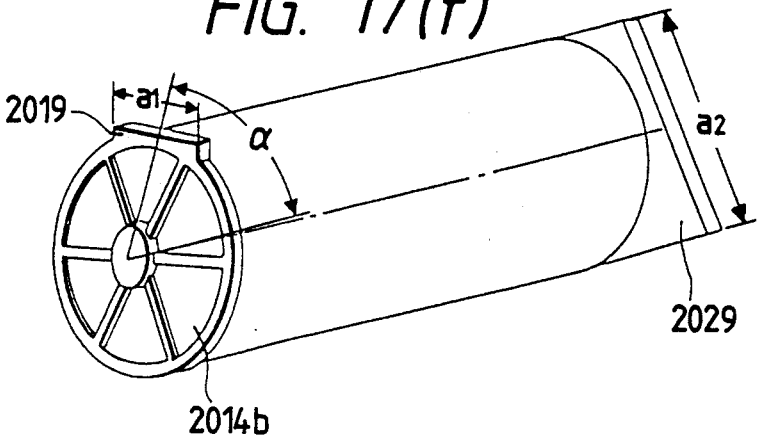
Figure 18A:
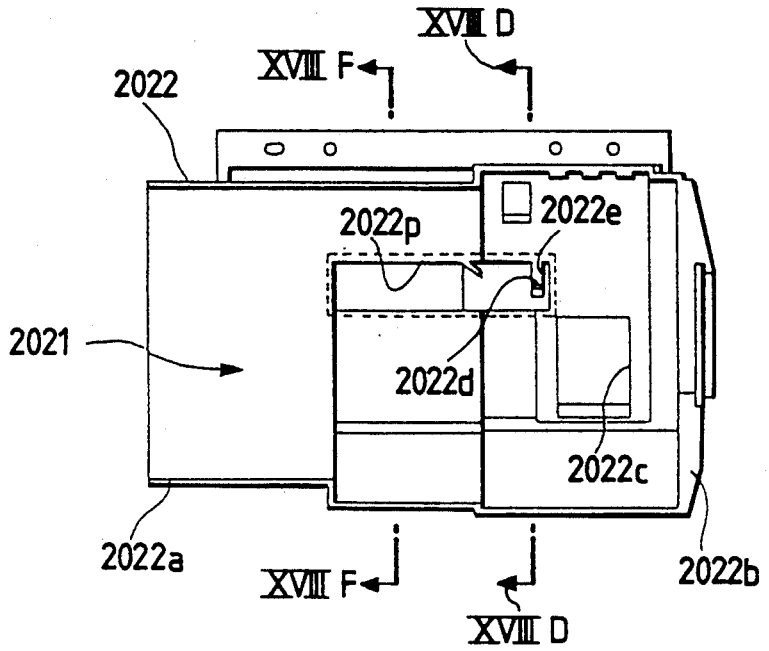
FIG. 18(*a*) is a front view showing an example of a cover in the color copying machine.
Figure 18C:
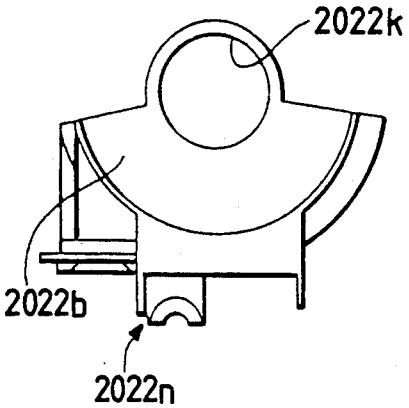
Figure 18B:
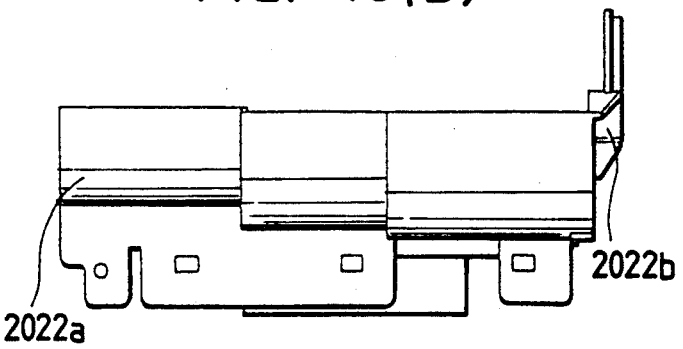
Figure 18D:
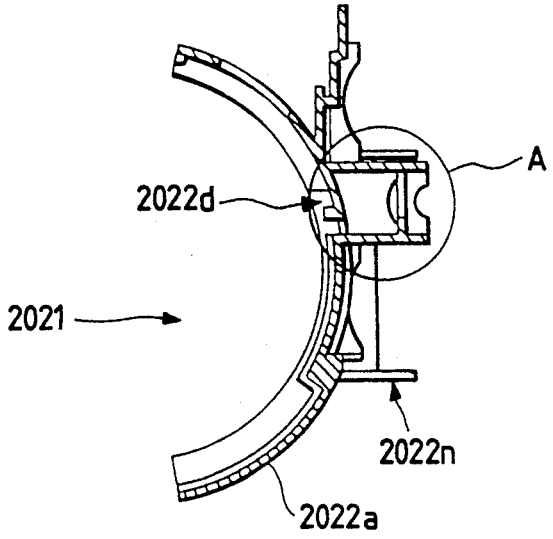
Figure 18E:
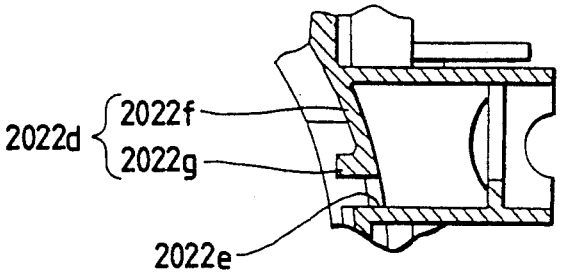
Figure 18F:
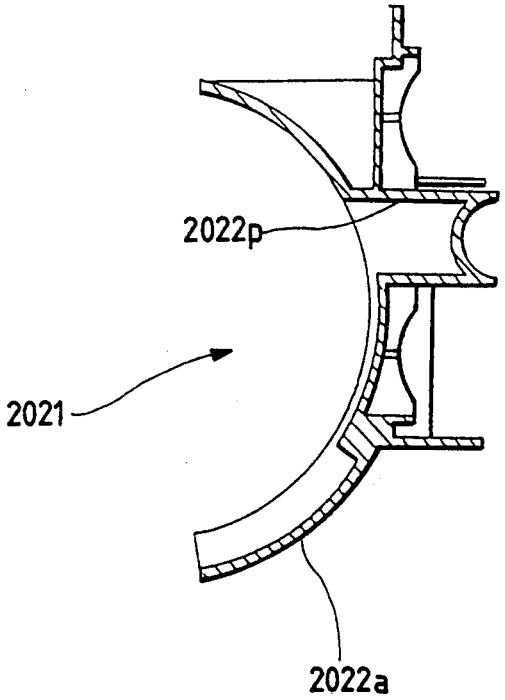

A toner supply device 2011, disposed above the first auger 2005 within the housing 2001, includes a toner cartridge 2012 filed with toner, and a reserve tank 2013 disposed under the toner cartridge 2012, as shown in FIGS. 15 and 16.

As shown in FIGS. 17(*a*) through 17(*d*), the cartridge 2012 comprises a case body 2014, a spiral agitator 2015, and a coupling 2016. The case body 2014 includes a tubular portion 2014*a* made of paper, and resin made, end walls 2014*b* closing both ends of the tubular portion. The spiral agitator 2015 consists of metal wire spirally coiled. The coupling 2016 is coupled with the spiral agitator 2015. The tubular portion 2014*a*, when made of paper, is advantageous in several points. For example, since it can be cut, it is cut to adjust its length so as to be adaptable for different types of machines. Since the paper is cheap, cost to manufacture the cartridge 2012 may be considerably reduced.

A toner supply port 2014*c* for supplying toner to the reserve tank 2013 is formed in the tubular portion 2014*a* at one end portion of the case body 2014. The toner supply port 2014*c* opens to a toner container 2017*a* as one of the toner containers of a tank portion 2017 of the reserve tank 2013.

The end 2015*a* of the spiral agitator 2015, which is closer to the toner supply port 2014*c*, is free. The other end 2015*b*, opposite to the end closer to the toner supply port, is rotatably supported by the inner surface of the end wall 2014*b*. A drive force transmission shaft 2015*c* is continuous to the end 2015*b*. The shaft 2015*c* extends along the axis of revolution towards the toner supply port 2014*c*. The distal end of the shaft is coupled with the coupling 2016, which is rotatably mounted on the center portion of the right-side end wall 2014*b*. A toner crushing member 2015*d*, shaped like a triangle protrusion, is formed at the portion of the drive force transmission shaft 2015*c*, which faces the toner supply port 2015*c*. Thus, the spiral agitator 2015 is cantilevered.

As shown in FIG. 17, a shutter 2018, mounted on the cartridge 2012, is circumferentially slidable. The shutter closes the toner supply port 1014*c* when the cartridge is not set to the toner supply device. As shown, a guide member 2014*d* is formed in the circumferential surface of the tubular member 2014*a* of the main body 2014. Guide grooves 2014*e* are circumferentially formed in the guide member 2014*d*. Both sides of the shutter 2018 are bent and the bent portions are slidably inserted into the guide grooves 2014*e*. A flexible sealing means (not shown) for closing the toner supply port 2014*c* is stuck on the case body 2014. The sealing means is fixed at one end to the shutter 2018. When the shutter is circumferentially slid, the sealing means is peeled off to open the toner supply port 2014*c*. As shown in FIG. 17(*c*), an unlock cam 2014*f* is provided on a location on the guide member 2014*d*, which is substantially opposed to the location of the shutter 2018 as circumferentially viewed.

As shown in FIG. 17(*f*), first and second positioning means 2019 and 2020 are provided on each end wall 2014*b*. The first positioning means 2019 protrudes from the circumferential edge of the end wall 2014*b*, which is closer to the toner supply port 2014*c*. The end face of the first positioning means 2019 is flat. The second positioning means 2020 protrudes from the circumferential edge of the end wall 2014*b*, which is far from the toner supply port 2014*c*, and its end face is flat. As best shown in FIGS. 17(*c*) and 17(*f*), the second positioning means 2020 is angularly shifted from the first positioning means 2019 by an angle $\alpha$, clockwise. The flat end face $a_2$ of the second positioning means 2020 is wider than that $a_1$ of the first positioning means 2019.

The unlock cam 1014*f*, as shown in FIG. 17(*c*), is angularly shifted from the first positioning means 2019 by a prescribed angle $\beta$, clockwise. The angle $\beta$ will be described in detail later.

As shown in FIGS. 15 and 16, the toner cartridge 2021 is removably set at a preset position in a cartridge set portion 2021 provided in the machine main body 2. As shown in FIGS. 18(*a*) through 18(*c*), the cartridge set portion 2021 is formed in a cover 2022 for closing an upper opening of the reserve tank 2013. The cover 2022 is formed, in one piece construction, of a semitubular frame 2022*a* for holding the toner cartridge 2012, a side wall 2022*b* provided at one end of the frame 2022*a*, and a mounting portion 2022*n* fitted on the upper end of the reserve tank 2013.

A rectangular opening 2022*c* is formed at a location closer to the side wall 2022*b* of the frame 2022*a*. As will be described later, through this opening 2022*c*, toner is supplied from the toner cartridge 2012 to the reserve tank 2013. As shown in FIG. 18(*d*), a lock 2022*d* is formed in the vicinity of the opening 2022*c* of the frame 2022*a*. As seen from FIG. 18(*e*), the lock 2022*d* includes an arm 2032*f* circumferentially extending from the frame 2022*a* within an opening 2022*e* formed in the frame 2022*a*, and a lock part 2022*g*, which at the tip of the arm, protrudes from the inner surface of the frame 2022*a*. When the arm 2022*f*, resiliently deformable, receives a force in the right direction in the drawing, the lock part 2022*g* retracts outwardly beyond the inner circumferential surface of the frame 2022*a*. When the force is removed, the lock part moves, by the resilient force, inwardly beyond the inner circumferential surface.

Figure 19A:
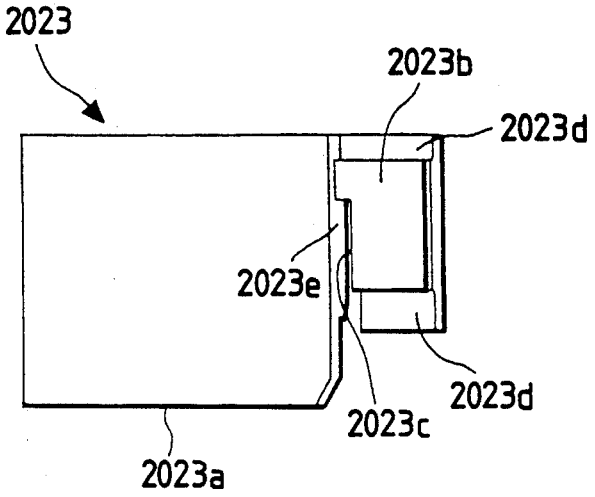
FIG. 19(*a*) is a plan view showing an example of a shutter in the color copying machine.
Figure 19B:
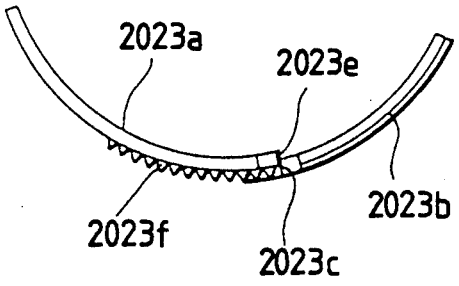
Figure 19C:
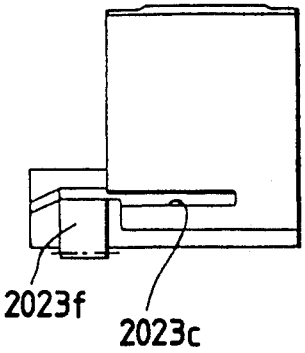

The opening 2022*c* of the frame 2022*a* of the cover 2022 is closed by the shutter 2023. As shown in FIG. 19, the shutter 2023, semicircular in cross section, includes a cartridge support 2023*a* for supporting the tubular portion 2014*a* of the toner cartridge 2012, and a shutter portion 2023*b* which supports a guide member 2014*d* of the toner cartridge 2012 and closes the opening 2022*c*. A cut-out groove 2023*c* is present between the support 2023*a* and the shutter portion 2023*b*. When the shutter 2023 is set to a prescribed location of the frame 2022*a* of the cover 2022, the lock part 2022*g* of the lock 2022*d* is fitted into this groove 2023*c*. This will be described later in detail.

Figure 20A:
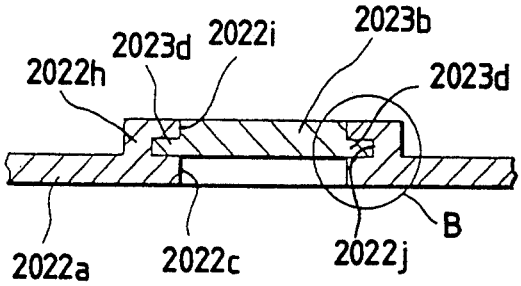
FIG. 20(*a*) is a sectional view taken on line VIII—VIII in FIG. 15.
Figure 20B:
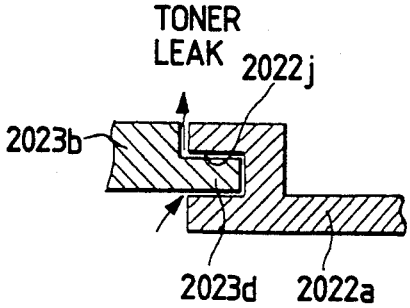

The inner circumferential surfaces of both the ends of the shutter portion 2023*b* consist of circumferentially extending, thinned parts 2023*d*. As shown in FIG. 20(*a*), each thinned part 2023*d* is fitted in a guide groove 2022*j* of the side wall of a concave portion 2022*i* elongated circumferentially along the guide member 2022*h*, which is provided near the opening 2022c of the frame 2022a. In this way, the shutter 2023 is assembled into the frame 2022a, while being circumferentially slidable. In a state that the shutter 2023 is assembled into the frame 2022a, the cut-out groove 2023c opens to the left with respect to the cover 2022 shown in FIG. 18(*a*). When the shutter 2023 is at the leftmost position where it completely closes the opening 2022c, as indicated by a two-dot chain line in FIG. 19, the lock 2022d is fitted into the cut-out groove 2023c. In this state, the shutter 2023 is circumferentially immovable, maintaining the closing of the opening 2022c. Foreign materials such as dust and particle will not enter the reserve tank 2013, through the opening 2022c.

As shown in FIGS. 18(*a*) and 18(*f*), a toner stay portion 2022p is formed in the frame 2022a, near the opening 2022c. The toner stay portion 2022p receives toner trailed by the shutter 2023 when it is opened and closed, and toner and the like leaked through a gap between the guide groove 2022j and the thinned parts 2023d of the shutter 2023. The toner is possibly leaked through the gap from the reserve tank 2013 in the direction of an arrow shown in FIG. 20(*b*), by a pressure by which the toner is kept under a fixed pressure within the reserve tank. Since the toner coming into the frame 2022a of the cover 2022 is thus received by the toner stay portion 2022p, the toner will not be sputtered within the frame 2022a, and such a situation will not take place that the toner filling the guide groove 2022j hinders the smooth closing and opening of the shutter 2033.

As shown in FIG. 18(*c*), a circular hole 2022k is formed in the side wall 2022b. A tubular protrusion 2014g formed in the side wall 2014b of the toner cartridge 2012 is inserted into the circular hole 2014b, when the toner cartridge 2012 is set. The cover 2022 thus constructed is set on the reserve tank 2013 in a state that the side wall 2022b of the cover is positioned on the side closer to a power transmission mechanism 2039 to be given later (on the ride side in FIG. 16). The toner cartridge 2012 is precisely positioned for the reserve tank 2013 and a drive gear 2039a of the power transmission mechanism, and set because the frame 2022a, side wall 2014b, and the mounting portion 2022n, which support the toner cartridge 2012 make up one piece. Since the toner cartridge 2012 is thus positioned and held by the frame 2022a, the setting of the toner cartridge 2012 is easy.

The one piece construction of the frame 2022a, side wall 2014b, and the mounting portion 2022n forms the cover as a toner receive container. Specifically, the semitubular frame 2022a and the side wall 2014b cooperate to form a container. With the construction, if toner unintentionally drops, the toner is completely received by the container before it enters the inside of the machine.

The prescribed angle $\beta$ between the first positioning means 2019$a_1$ and the unlock cam 2014f will be described. The angle $\beta$ is selected to be such a value that when the planar surface of the first positioning means 2019$a_1$ is directed upwardly and then horizontally, the unlock cam 2014f axially faces the cut-out groove 2023c. Accordingly, when, after the toner cartridge 2012 is set to the cartridge set portion 2021, the toner cartridge 2012 is axially moved toward the side wall 2022b, while the first positioning means 2019$a_1$ is held horizontally, the unlock cam 2014f enters the cut-out groove 2023c. Then, the lock 2022d having been fitted into the cut-out groove 2023c is pushed by the unlock cam 2014f and gets out of the groove 2023c.

Figure 21:
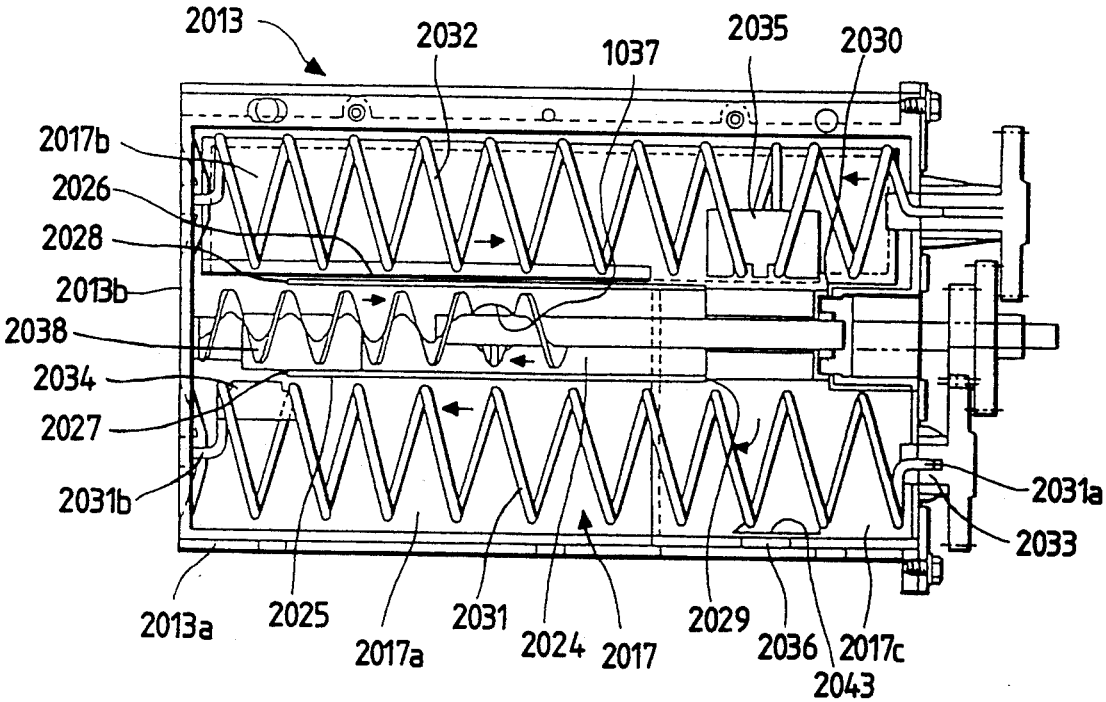
FIG. 21 is a sectional view of a reserve tank in the color copying machine.
Figure 22:
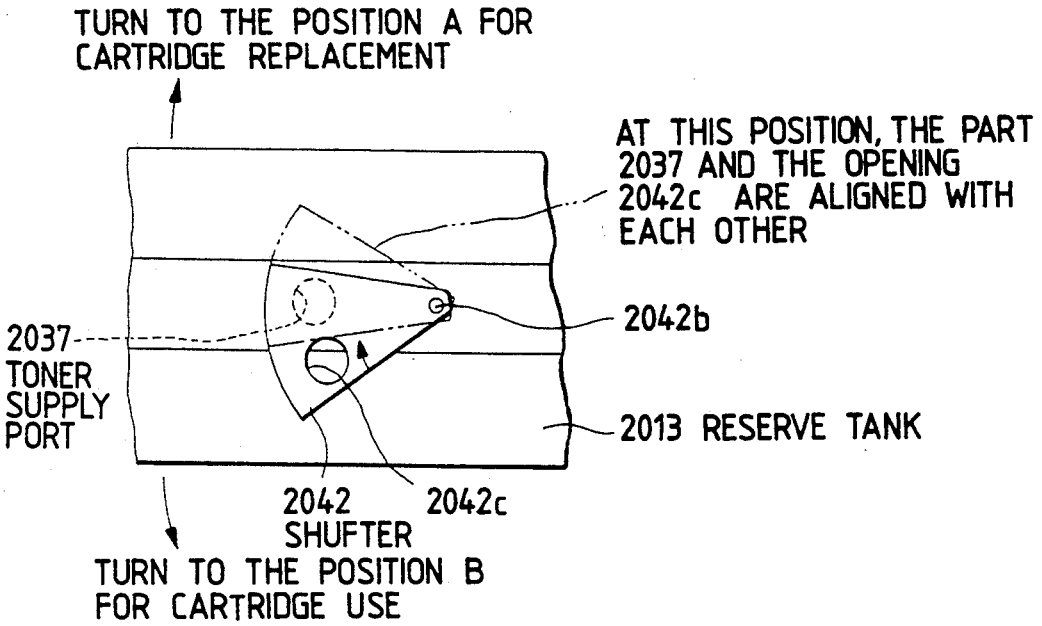
FIG. 22 is a diagram showing a shutter for opening and closing a toner supply hole of the reserve tank.

As illustrated in FIGS. 15 and 16, and 21, the reserve tank 2013 includes a tank section 2017 consisting of toner containers 2017a and 2017b, and a toner supply section 2024, disposed between the containers 2017a and 2017b, for supplying toner to the developing means 53. Partition walls 2025 and 2026 are provided partitioning the toner containers 2017a and 2017b, and the toner supply section 2024. As shown in FIG. 21, the partition walls 2025 and 2026 extend toward the left wall 2013b of the body 2013a of the reserve tank 2013, but fail to reach the wall to form openings 2027 and 2028 between the left wall 2013b and the left ends of the partition walls 2025 and 2026. The partition walls 2025 and 2026 have respectively openings 2029 and 2030 at locations deviated from the right ends to the left. Through the openings 2027, 2028, 2029, and 2030, the toner containers 2017a, 2017b, an the toner supply section 2024 communicate with one another.

Spiral agitators 2031 and 2032 formed of spirally coiled metal lines, for example, wires are disposed parallel to each other within the toner containers 2017a and 2017b. The right end 2031a of the spiral agitator 2031 is coupled with a gear shaft 2033, while the left end 2031b is rotatably supported by the left wall 2013b. The spiral agitator 2031 is coiled unidirectional. A blade 2034 is mounted on the portion of the spiral agitator 2031, which faces the opening 2027. The other spiral agitator 2032 is also supported at both ends in a similar way. In the left portion of the spiral agitator 2032 with respect to the opening 2030, the spiral agitator 2032 is coiled in the same direction as the coiled direction of the spiral agitator 2031, but in the right portion, it is coiled in the direction opposite to the former. A blade 2035 is mounted to the portion where the coiling direction is changed, viz., the portion facing the opening 2030.

A portion of the toner container 2017a on the ride side of the opening 2029 serves as a toner introducing portion 2017c. An empty sensor 2036 is provided on the side wall of the body 2013a at a location relatively to the left from the position facing the toner supply port 2014c of the cartridge 2012 in FIG. 21. The empty sensor 2036 is provided for sensing presence or absence of toner within the cartridge 2012.

A toner supply hole 2037 for supplying toner to the developing means 53 is provided at a preset location on the bottom of the toner supply section 2024. Disposed within the toner supply section 2024 is an auger 2038 arranged in parallel to two spiral agitators 2031 and 2032. The auger is also rotatably supported by the body 2013a as the spiral agitators 2031 and 2032. The coiling directions of the coiled blade of the auger 2038 are opposite to each other with respect to the supply hole 2037.

In connection with the reserve tank 2013 thus constructed, when the cartridge 2012 is set to the cartridge set portion 2026, the shutter 2018 slides and the toner supply port 2014c automatically opens concurrently with the sliding operation. Then, the toner is introduced from the cartridge 2012 to the toner introducing portion 2017c in the reserve tank 2013, through the toner supply port 2014c and the opening 2022c. With rotation of the spiral agitator 2031, the introduced toner is transferred to the left while at the same time is sensed by the empty sensor 2036. While the toner is transferred to the left, new toner is introduced into the toner introducing portion 2017c, from the cartridge 2012. When the toner reaches the left end of the toner container 2017*a*, the toner is transferred, with the blade 2034, toward the toner supply section 2024, through the opening 2027. A part of the toner transferred to the toner supply section 2024 is transferred toward the supply hole 2037 by means of the auger 2038. The toner is further transferred through the toner supply hole 2037 toward the developing means 53. It is noted here that the toner, after passing the supply hole 2037, is returned to the supply hole 2037, with the blade of the auger of which the coiled direction is reversed, as recalled. Accordingly, the toner is reliably transferred toward the developing means 53, through the supply hole 2037.

The remaining part of the toner transferred to the toner supply section 2024 is pushed forwardly by new incoming toner transferred by the blade 2034, and flows through the opening 2028 to the toner container 2017*b*. In the toner container 2017*b*, the toner is transferred toward the right opening 2030 by means of the spiral agitator 2032. The toner reaches the opening 2030 and is transferred, by the blade 2035, to the toner container 2017*a* through the openings 2030 and 2029. The toner, if passing the opening 2030, is returned to the opening 2030 by the spiral agitator 2032 reversely coiled. The toner, when entering the toner container 2017*a*, is transferred again to the left by the spiral agitator 2031. In this case, the toner is reliably transferred to the left by the spiral agitator 2031, so that the toner coming through the opening 2029 will not be transferred to the left or toward the toner introducing portion 2017*c*. Consequently, only the toner supplied from the cartridge 2012 is introduced into the toner introducing portion 2017*c*.

In this way, a prescribed amount of toner within the reserve tank 2013 is transferred from the supply hole 2037 to the developing means 53, while the remaining toner circulates between the toner containers 2017*a* and 2017*b*. The toner circulation prevents the toner from lumping within the containers 2017*a* and 2017*b*.

In this embodiment, the numbers of turns and revolutions of the spiral agitator 2031 and the auger 2038 are selected so that a toner transfer force of the spiral agitator of 2031 is larger than that of the auger 2038. Accordingly, the amount of toner transferred by the spiral agitator 2031 is smaller than that transferred to the toner supply hole 2037 by the auger 2038. When the toner is transferred under this condition, the toner is pressed against the toner supply section 2024 by the spiral agitator 2031, resulting in increase of the toner pressure. When the toner pressure reaches a fixed pressure, the pressed toner will pass through the hollow of the spiral agitator 2031 even if the spiral agitator 2031 will supply further toner thereto, so that the toner pressure fails to increase in excess of the fixed toner pressure. In this way, the toner pressure of the toner supplied to the toner supply section 2024 is kept substantially constant, so that the amount of toner supplied from the toner supply hole 2037 to the developing unit is also kept substantially constant. As a consequence, the dispensing operation is stable and a density of the resultant picture is also stable.

The volumes of the toner containers 2017*a* and 2017*b* are selected such that 2000 to 3000 number of copies can be made till a new cartridge is set after the cartridge 2012 is empty.

As shown in FIGS. 15 and 16, the shutter 2042 is provided on the outer circumferential surface of the toner supply section 2024 in the reserve tank 2013, while covering the toner supply hole 2037. As best illustrated, the shutter 2042 is formed of a fan-shaped plate 2042*a*. The fan-shaped plate 2042*a* may be swung about its center fixed to the bottom outer wall of the reserve tank 2013. The shutter 2042 is biased to one side by bias means, such as a spring. An opening 2042*c*, which resembles the toner supply hole 2037 of the reserve tank 2013, is formed in the plate 2042*a*. When for replacement of the toner cartridge 2012, the reserve tank 2013 is sprung out of the main body 2 of the copying machine as will subsequently be described, the shutter 2042 is turned, by the spring, to close the toner supply hole 2037. When the reserve tank 2013 shown in FIGS. 15 and 16 is set to the main body 2, the shutter 2042 engages with an engaging part 2044*b* of a tubular member 2044 of the agitating means 43, and turns resisting the spring force till the opening 2042*c* is aligned with the toner supply hole 2037 of the reserve tank 2037. In this state of the reserve tank 2013 being set, the toner supply hole 2037 is opened to communicate with a toner introducing port 2044*a* of the tubular member 2044. With use of the shutter 2042, no toner drops from the reserve tank 2013 when the toner cartridge is replaced.

A cover member 2043 is provided as an integral part on the bottom, outer surface of the reserve tank 2013. The bottom 2043*a* of the cover member is located under the reserve tank 2013. The bottom 2043*a* receives toner, which drops from a joint part of the reserve tank 2013 and the tubular member 2044 of the agitating means 53, when the toner cartridge is replaced. Accordingly, the inside of the main body 2 of the copying machine 1 and the floor on which the machine 1 is located will not be soiled with the toner. The lower end of the cover member 2043 is supported by the main body 2 (not shown), so that it is set at a fixed vertical position, and the weight of the dispenser unit 2041 will not be applied to the developing unit.

Figure 23:
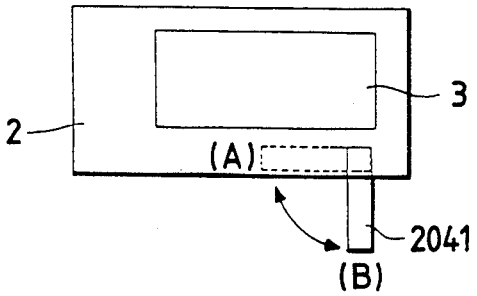
FIG. 23 is a diagram showing the setting of a toner cartridge.
Figure 24:
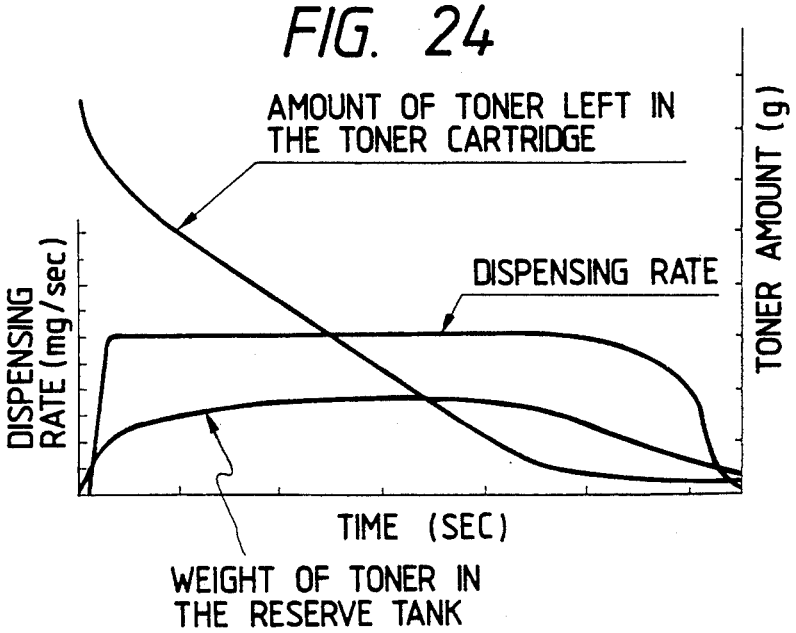
FIG. 24 is a graph showing a dispense rate variation and a toner amount variation with respect to time.

As shown in FIG. 23, a dispenser unit, supported by the main body 2 of the copying machine, is swung between two positions A and B. The dispenser unit incorporates the cartridge 2012, cartridge set portion 2021, reserve tank 2013, power transmission mechanism 2039, and motor drive means 2040. In the position A as indicated by a dashed line and extended laterally in the main body 2, the cartridge 2012 is set and used. In the position as indicated by a solid line and extended vertically in the main body 2 and located outside the main body, the cartridge 2012 is replaced with a new one. For replacement of the cartridge, the dispenser unit 2041 is turned to the replacing position B. An old cartridge 2012 is removed, and a new cartridge is set in the cartridge set portion 2026. Thereafter, the dispenser unit is turned to the position A and fixed thereat.

Description to follow is how the toner cartridge 2012 is set to the cartridge set portion 2021. As shown in FIG. 23, a user first turns the dispenser unit 2041 to the replacing position B, and locates the toner cartridge 2012 on the cartridge set portion 2021 in a state that the first positioning means 2019 of the cartridge is positioned above and directed horizontally. In this state, the toner cartridge 2012 is axially moved forwardly (to the right in FIG. 16).

If the toner cartridge 2012 is a toner cartridge designed to be used exclusively for the copying machine under discussion, the unlock cam 2014*f* of the toner cartridge 2012 is placed facing the cut-out groove 2023*c*, and the unlock cam 2014*f* is fitted into the cut-out groove 2023*c*. Accordingly, the toner cartridge 2012 is allowed to move up to a preset position on the axial path along which the tubular protrusion 2014*g* is fitted into the circular hole 2022*k* of the cover 2022. If the cartridge containing the toner incompatible with the copying machine under used or the imitative toner, the unlock cam 2014*f* is placed not facing the cut-out groove 2023*c*. Accordingly, the unlock cam 2014*f* cannot be fitted into the cut-out groove 2023*c*, and hence the toner cartridge cannot be moved up to the preset position. Thus, setting such cartridges to the cartridge set portion 2021 is rejected. In other words, the user will not set an incorrect toner cartridge to the cartridge set portion.

When the unlock cam 2014*f* is inserted into the cut-out groove 2023*c*, the cam 2014*f* pushes the lock 2022*d* to expel it out of the cut-out groove 2023*c*. Then, the shutter 2023 is slidable in the circumferential direction. In this state, if the toner cartridge 2012 is turned counterclockwise in FIG. 15 (the user turns it clockwise), the end 2014*h* of the guide member 2014*d* closer to the guide member 2014*d* comes in contact with the end 2023*e* of the cartridge support 2023*a* closer to the shutter portion 2023*b*. Accordingly, the shutter 2023 turns together with the toner cartridge 2012. With rotation of the shutter 2023, the opening 2022*c* of the cover 2022 is opened. One end 2018*a* of the shutter 2018 of the toner cartridge 2012 engages with the engaging part 2022*m*. As a result, if the toner cartridge 2012 is turned, the shutter 2018 will not turn together with the cartridge. In other words, the shutter 2018 turns relative to the toner cartridge 2012, so that the toner supply port 2014*c* is opened. In this way, both the shutters 2018 and 2023 turn in connection with the turn of the cartridge 2012, and the toner supply port 2014*c* and the opening 2022*c* automatically open. When the toner cartridge 2012 is turned, the guide groove 2014*e* forming part of the guide member 2014*d* is fitted into the concave portion 2022*i* of the guide member 2022*h*. The result is that the toner cartridge 2021 is immovable in the axial direction.

The toner cartridge 2012 is then turned at a prescribed angle $\alpha$. The second positioning means 2020 is horizontally postured, so that the toner cartridge 2012 is set in place. When the toner cartridge 2012 is set in place, the toner supply hole 2014*c* and the opening 2022*c* are both opened. Accordingly, toner is introduced from the toner cartridge 2012 into the toner introducing portion 2017*c* of the reserve tank 2017, through the toner supply hole 2014*c* and the opening 2022*c*. Finally, the dispenser unit 2041 is turned to set the toner cartridge 2012 to the position A. Here, the setting of the toner cartridge is completed.

When the toner in the cartridge 2012 is used up and the cartridge must be replaced with a new one, a user turns the dispenser unit 2041 to set the cartridge 2012 to the replacing position B. Then, he turns the cartridge 2012 till the first positioning means 2019 is set horizontally in FIG. 15. In this state, the guide member 2014*d* slips out of the concave portion 2022*i* of the guide member 2022*h*, and the shutter 2023 turns to open the opening 2022*c*. The shutter 2018 also moves relative to the toner cartridge to close the toner supply port 2014*c*.

Then, the toner cartridge 2012 is axially moved to the left in FIG. 16, and then the toner cartridge 2012 may be removed. With the movement of the toner cartridge 2012, the unlock cam 2014*f* gets out of the cut-out groove 2023*c*, and the lock 2022*d* is fitted into the groove 2023*c*. The result is that the shutter 2023 is locked to be immovable in the circumferential direction. The user discards the empty toner cartridge and sets a new toner cartridge 2012 filled with toner. The setting operation is the same as mentioned above, and hence no further description will be given here.

As seen from the foregoing description, in the present invention, a toner transfer force of the spiral agitator 2031 is larger than that of the auger. Accordingly, the toner pressure within the reserve tank is kept substantially constant, providing a stable dispensing operation.

Further, foreign materials will not enter the reserve tank through the opening of the cover. The shutter is automatically opened and closed when the toner cartridge is set, providing an easy operation.

The shutter is unlocked only when a correct toner cartridge is used. In other words, setting of the toner incompatible with the copying machine under use or the imitative toner to the machine, is rejected.

In loading the toner cartridge, the cartridge is automatically set in place by the positioning means and held in the cover holder. Accordingly, the toner cartridge can be loaded in an exact and simple manner.

The toner leaked from the reserve tank is received by the toner staying portion. The problems of the unsmooth operation of the shutter and the sputtering of toner, which are caused by the leaked toner, can be solved.

The toner dropping from a gap between the developing unit and the toner dispenser unit is received by the cover member, so that it will not soil the machine inside and the floor on which the machine is located.

A fourth embodiment of the invention will be described with reference to the accompanying drawings. In the figures to be referred to in the following description, like reference symbols are used for designating like or equivalent portions in FIGS. 13, 14, and 16 through 21 used for the description of the third embodiment.

Figure 25A:
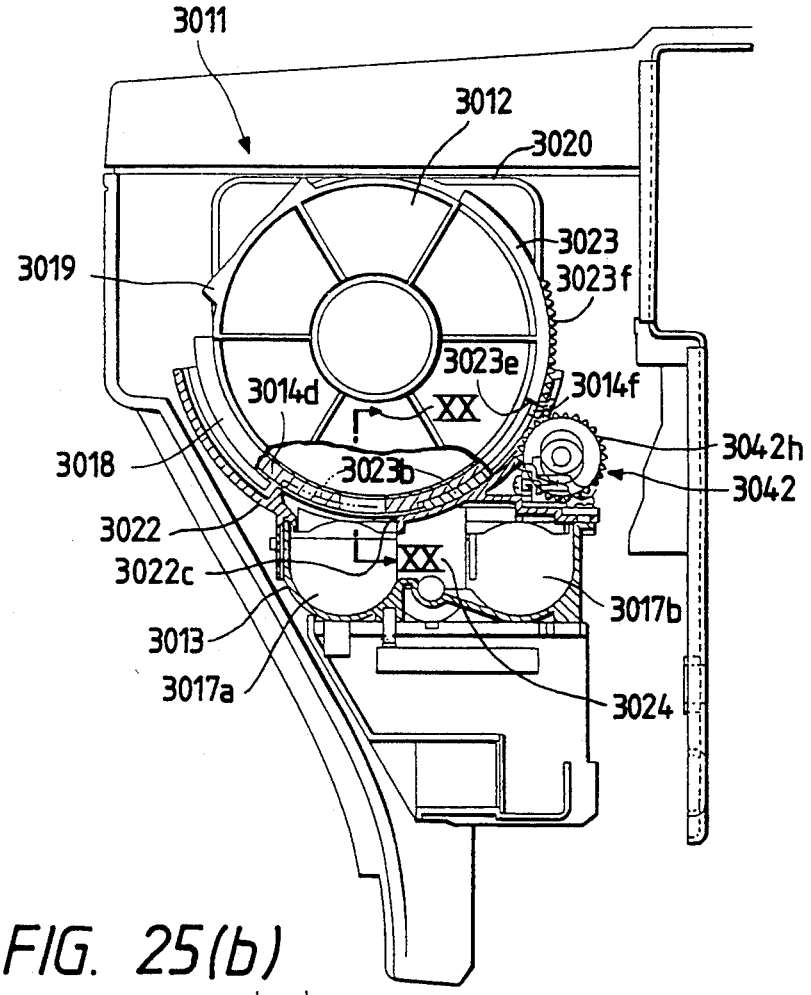
FIG. 25(*a*) is a cross sectional view showing a toner supply device to which a fourth embodiment of a toner cartridge according to the present invention is applied.
Figure 25B:
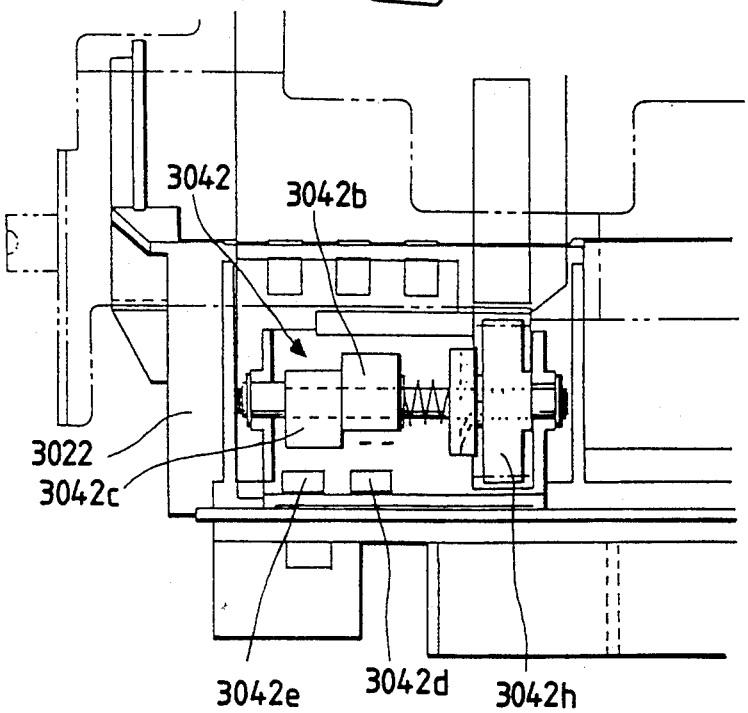
Figure 26A:
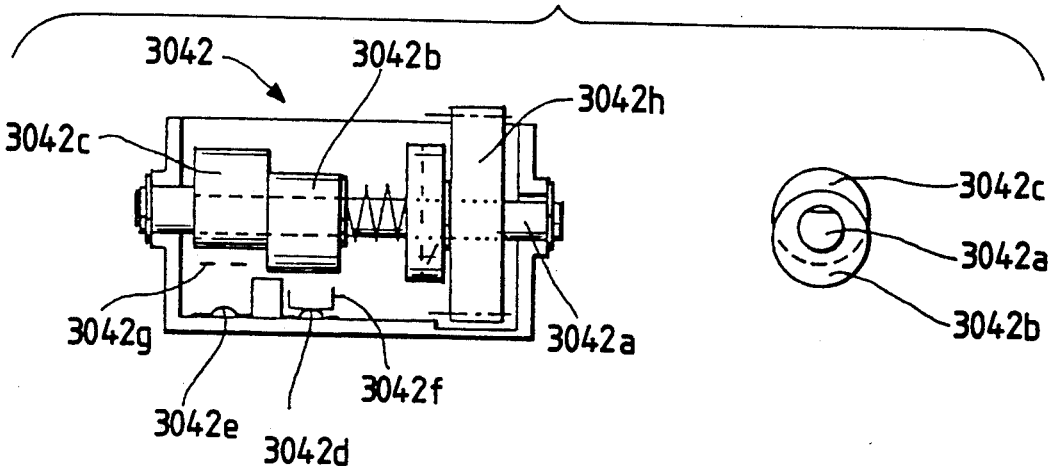
FIG. 26(*a*) is a diagram showing an on state of a first switch of a 2-contact switch.
Figure 26B:
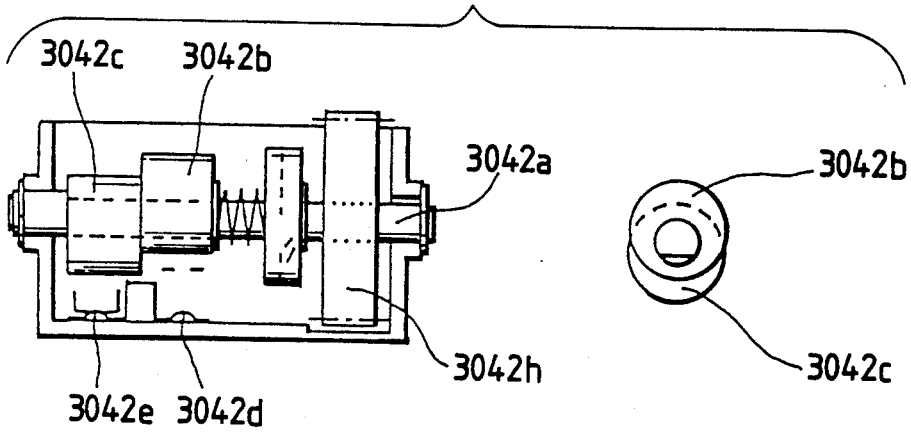

As shown in FIGS. 25(*a*) and 25(*b*), the cover 2022 is provided with a two-contact switch 3042. As shown in FIG. 26, the two-contact switch 3042 includes first and second cams 3042*b* and 3042*c* fixed to a rotating shaft 3042*a*, and first and second switches 3042*d* and 3042*e* which are respectively turned on and off by the first and second cams 3042*b* and 3042*c*. The first and second cams 3042*b* and 3042*c* are angularly shifted by 180°. As shown in FIG. 25(*a*), when the first cam 3042*b* is at the bottom position, a cam follower 3042*f* moves down, to turn on the first switch 3042*b* and to turn off the second switch 3042*c*. As shown in FIG. 25(*b*), the second cam 3042*c* is at the bottom position, a cam follower 3042*g* moves down, to turn on ff the second switch 3042*c* and to turn off the first switch 3042*b*.

The rotating shaft 3042*a* is coupled with a gear 3042*h* by way of a one-way clutch, not shown. When the rotating shaft 3042*a* rotates in one direction, the gear 3042*h* is fixed to the shaft 3042*a* through the action of the one-way clutch. A rotation of the gear 3024*h* is transferred to the rotating shaft 3042*a*, and the first and second cams 3042*b* and 3042*c*. When the rotating shaft 3042*a* rotates in the other direction, the gear 3042*h* is free from the shaft 3042*a*. The rotation of the gear 3024*h* is not transferred to the rotating shaft 3042*a*, and the first and second cams 3042*b* and 3042*c*.

As shown in FIGS. 25(*a*) and 25(*b*), the gear 2042*h* is in mesh with a gear 3023*f* mounted on the shutter 3023. In FIG. 25(*a*), when the shutter 3023 rotates counterclockwise, i.e., in the direction to set the toner cartridge 3012, the gear 3042*h* rotates clockwise (corresponds to one direction as mentioned above), thereby to turn the rotating shaft 3042*a*, and the first and second cams 3042*b* and 3042*c*, through the one-way clutch. As a result, the on and off states of the first and second switches 3042*d* and 3042*e* are exchanged with each other.

When the shutter 3023 rotates clockwise, i.e., in the direction to remove the toner cartridge 3012, the gear 3042*h* rotates counterclockwise (corresponds to the other direction as mentioned above), so that the one-way clutch shuts off the transmission of the rotation of the gear 3042*h* to the rotating shaft 3042*a*. Under this condition, the first and second cams 3042*b* and 3042*c* will not turn, and the on and off states of the first and second switches 3042*d* and 3042*e* remain as they are.

As illustrated in FIGS. 15 and 16, and 21, the reserve tank 2013 includes a tank section 2017 consisting of toner containers 2017*a* and 2017*b*, and a toner supply section 2024, disposed between the containers 2017*a* and 2017*b*, for supplying toner to the developing means 53. Partition walls 2025 and 2026 are provided partitioning the toner containers 2017*a* and 2017*b*, and the toner supply section 2024. As shown in FIG. 21, the partition walls 2025 and 2026 extend toward the left wall 2013*b* of the body 2013*a* of the reserve tank 2013, but fail to reach the wall to form openings 2027 and 2028 between the left wall 2013*b* and the left ends of the partition walls 2025 and 2026. The partition walls 2025 and 2026 have respectively openings 2029 and 2030 at locations deviated from the right ends to the left. Through the openings 2027, 2028, 2029, and 2030, the toner containers 2017*a*, 2017*b*, an the toner supply section 2024 communicate with one another.

Spiral agitators 2031 and 2032 formed of spirally coiled metal lines, for example, wires are disposed parallel to each other within the toner containers 2017*a* and 2017*b*. The right end 2031*a* of the spiral agitator 2031 is coupled with a gear shaft 2033, while the left end 2031*b* is rotatably supported by the left wall 2013*b*. The spiral agitator 2031 is coiled unidirectional. A blade 2034 is mounted on the portion of the spiral agitator 2031, which faces the opening 2027. The other spiral agitator 2032 is also supported at both ends in a similar way. In the left portion of the spiral agitator 2032 with respect to the opening 2030, the spiral agitator 2032 is coiled in the same direction as the coiled direction of the spiral agitator 2031, but in the right portion, it is coiled in the direction opposite to the former. A blade 2035 is mounted to the portion where the coiling direction is changed, viz., the portion facing the opening 2030.

The portion of the toner container 2017*a* on the ride side of the opening 2029 is used as the toner introducing portion 2017*c*. This toner introducing portion faces the tone supply port 2014*c* of the toner cartridge 2012. In FIG. 21, the location on the left side of the side wall of the body 2013*a* of the reserve tank with respect to the location facing the toner supply port 2014*c*, is not soiled with the leak toner, which would take place at the time of replacement of the toner cartridge 2012.

The empty sensor 3036 is provided at such a position as to detect the amount of toner left in the reserve tank with which 2 to 3 KC copies (2000 to 3000 times) are possible. Placement of the empty sensor 3036 at such a position eliminates an erroneous sensing of toner, which is due to the leak toner, and allows 2 KC (2000 times) copies after the empty of the reserve tank is sensed.

When the empty sensor 3036 senses the empty state consecutively 10 times in a black copy mode, control decides that the reserve tank is empty, and continues the sensing of the empty state till the empty sensing is removed. In this case, if the power source of the copying machine is turned off in the black copy mode, the empty sensing operation continues. Such a definition of the empty sensing can prevent the empty sensor 3036 from erroneously operating. If the empty sensor 3036 senses an empty state of the reserve tank on the basis of the definition, a display window on the control panel of the copying machine 1 presents a message "Supply toner". If 2000 copies are performed after the empty message is presented, the machine 1 is shut down. In this state, the display presents messages "Cannot operate for copy" and "Supply toner" or a flashing indication.

As shown in FIGS. 21 and 27(*a*), a pair of cleaning members 3034 are angularly disposed angularly separated by 180° at a location facing the empty sensor 3036 of the spiral agitator 2031. The cleaning members are provided for cleaning, to some extend, toner attached to the sensor surface of the sensor 3036. Each cleaning member 3034, shaped like a trapezoid, is formed of a resilient wire of 0.1 to 0.5 mm in diameter made of nonmagnetic Sus, such as piano wire. When the wire diameter is less than 0.1 mm, it is difficult to handle the cleaning wires 3043, and the wires are readily bent by toner weight to lose their cleaning function. When the diameter is larger than 0.5 mm, the cleaning members 3043 are repeatedly deformed with the rotation of the agitator, and extremely are cut. It is for this reason that the diameter should be set within the above range of figures. With use of wires for the cleaning members 3034, the wires pass through the toner when the agitator rotates, and will carry the toner. In a state that a sufficient amount of toner is left, the cleaning members will not wipe the toner out of the sensor surface. Accordingly, the erroneous sensing by the empty sensor 3036 will not take place.

As shown in FIG. 27(*b*), the cleaning members 3043 each extend in the tangential direction of the agitator and the direction opposite to the rotating direction. Both ends of each member are mounted to the spiral agitator 2031. The cleaning members are each disposed such that the linear part of it faces the sensor surface of the empty sensor 3036, with a space of 0 to 0.5 mm between them. In one of the constructions to maintain the space, as shown in FIGS. 27(*c*) and 27(*d*), a pair of projections 3044 of 0 to 0.5 mm high are provided on both sides of the sensor surface of the empty sensor 3036. The projections 3044 are oriented to cross the moving direction of the cleaning members 3043. In another construction, as shown in FIG. 27(*e*), the empty sensor 3036 is disposed such that the sensor surface is backwardly separated from the inner surface of the side wall of the body 2013*a*, by 0 to 0.5 mm. It is evident that another suitable construction is available for the maintenance of the gap.

With the construction as stated above, the cleaning members 3034 can make clean the sensor surface in a noncontact manner. The cleaning members 3043 will not rub the sensor surface, thereby not to wear off the sensor surface. The extension of the cleaning members 3043 in the tangential direction of the agitator and in the direction opposite to the rotating direction, ensures a satisfactory strength of the cleaning members 3043.

Two or more cleaning members 3043 may obviously be used.

In a case where after the empty sensor 3036 senses an empty state of the reserve tank, and "Supply toner" is displayed on the control panel, a user replaces the old cartridge with a new one, the display of the message must be lit off. At the time of toner cartridge replacement, the user sometimes turns off the power switch of the copying machine 1. It is to cope with the situations that the first and second switches 3042*d* and 3042*e* are provided.

In the embodiment, the on and off states of the first and second switches 3042*d* and 3042*e* are exchanged with each other every time the toner cartridge 2012 is replaced. A switch being in an on state is constantly stored in a nonvolatile memory. When an old toner cartridge is removed for the cartridge replacement, the memory has stored the memory being in an on state immediately before the removal of the cartridge.

In practical use, the user sometimes turns off the power switch in a state that an old toner cartridge is removed, but a new tone cartridge is not yet set. In this case, the message "Supply toner" is still present on the control panel. The message teaches that the cartridge replacement is improper. When the user turns on the power switch after a new toner cartridge is set, the on-state switch is changed to another one in synchronism with the loading operation of the cartridge. Then, the switch in the memory is changed and the message "Supply toner" disappears on the display.

After a new toner cartridge is loaded and the message of "Supply toner" disappears, the empty sensor 3036 is inhibited from sensing an empty state of the reserve tank while copying operations are performed 1000 times. The empty sensor, if so set, will not sense an empty state of the reserve tank before a sufficient amount of toner is supplied to the reserve tank after a new toner cartridge is loaded.

The empty sensor 3036 senses an empty state of the reserve tank 2013, and cannot sense an amount of toner left in the toner cartridge 2012. To know an approximate time of cartridge replacement, however, it is desirable to predict an amount of toner left in the toner cartridge 2012. To this end, the present embodiment employs the following technique to predict the amount of toner left in the cartridge.

The predicting technique is base on the fact that the number of black copies is determined by an amount of toner contained in the toner cartridge 2012, and takes a substantially fixed value (e.g., 20 KC). Specifically, the number of black copies is counted, and an amount of tone left in the toner cartridge 2012 is predicted using a count obtained. In this case, the copying machine counts the number of black copies, and the result of count is stored in the diag. of the machine. A serviceman reads its count, to check the amount of left toner. When the count is approximate to 20 KC, he tells the user that the replacement of the toner cartridge is needed in near future. The count of the number of copies is reset when a new toner cartridge is set, that is, when the switch to be turned on is changed. For the new toner cartridge, the machine starts to count from 0, again.

A toner supply hole 2037 for supplying toner to the developing means 53 is provided at a preset location on the bottom of the toner supply section 2024. Disposed within the toner supply section 2024 is an auger 2038 arranged in parallel to two spiral agitators 2031 and 2032. The auger is also rotatably supported by the body 2013*a* as the spiral agitators 2031 and 2032. The coiling directions of the coiled blade of the auger 2038 are opposite to each other with respect to the supply hole 2037.

In connection with the reserve tank 2013 thus constructed, when the cartridge 2012 is set to the cartridge set portion 2026 to be ready for use, the shutters 2018 and 2023 slide and the toner supply port 2014*c* automatically opens concurrently with the sliding operation. Then, the toner is introduced from the cartridge 2012 to the toner introducing portion 2017*c* in the reserve tank 2013, through the toner supply port 2014*c* and the opening 2022*c*. With rotation of the spiral agitator 2031, the introduced toner is transferred to the left while at the same time is sensed by the empty sensor 2036. While the toner is transferred to the left, new toner is introduced into the toner introducing portion 2017*c*, from the cartridge 2012. When the toner reaches the left end of the toner container 2017*a*, the toner is transferred, with the blade 2034, toward the toner supply section 2024, through the opening 2027. A part of the toner transferred to the toner supply section 2024 is transferred toward the supply hole 2037 by means of the auger 2038. The toner is further transferred through the toner supply hole 2037 toward the developing means 53. It is noted here that the toner, after passing the supply hole 2037, is returned to the supply hole 2037, with the blade of the auger of which the coiled direction is reversed, as recalled. Accordingly, the toner is reliably transferred toward the developing means 53, through the supply hole 2037. The remaining part of the toner transferred to the toner supply section 2024 is pushed forwardly by new incoming toner transferred by the blade 2034, and flows through the opening 2028 to the toner container 2017*b*. In the toner container 2017*b*, the toner is transferred toward the right opening 2030 by means of the spiral agitator 2032. The toner reaches the opening 2030 and is transferred, by the blade 2035, to the toner container 2017*a* through the openings 2030 and 2029. The toner, if passing the opening 2030, is returned to the opening 2030 by the spiral agitator 2032 reversely coiled. The toner, when entering the toner container 2017*a*, is transferred again to the left by the spiral agitator 2031. In this case, the toner is reliably transferred to the left by the spiral agitator 2031, so that the toner coming through the opening 2029 will not be transferred to the left or toward the toner introducing portion 2017*c*. Consequently, only the toner supplied from the cartridge 2012 is introduced into the toner introducing portion 2017*c*.

In this way, a prescribed amount of toner within the reserve tank 2013 is transferred from the supply hole 2037 to the developing means 53, while the remaining toner circulates between the toner containers 2017*a* and 2017*b*. The toner circulation prevents the toner from lumping within the containers 2017*a* and 2017*b*.

The volumes of the toner containers 2017*a* and 2017*b* are selected such that 2000 to 3000 number of copies can be made till a new cartridge is set after the cartridge 2012 is empty.

Figure 28:
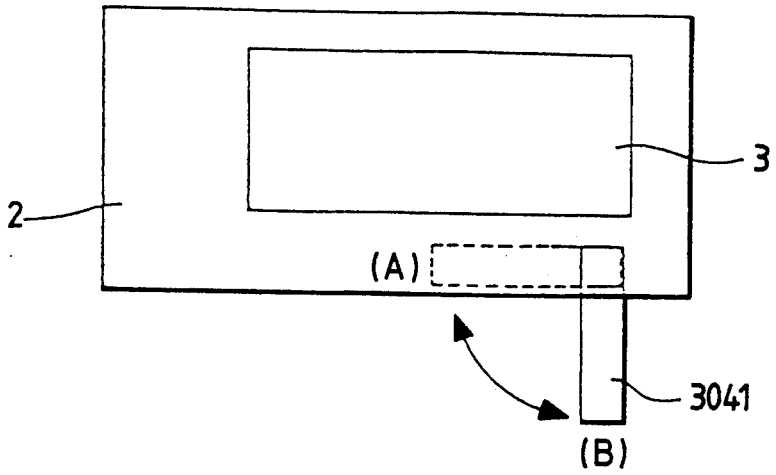
FIG. 28 is an explanatory diagram showing the setting of a toner cartridge.
Figure 27A:
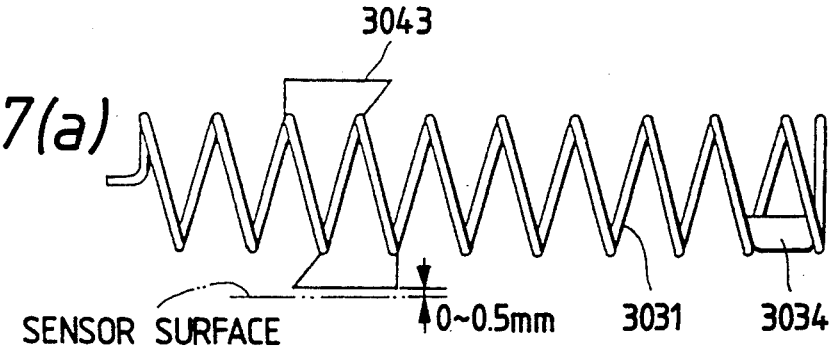
FIG. 27(*a*) is a front view showing a cleaning member mounted on an agitator.
Figure 27B:
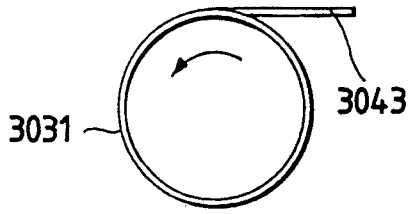
Figure 27C:
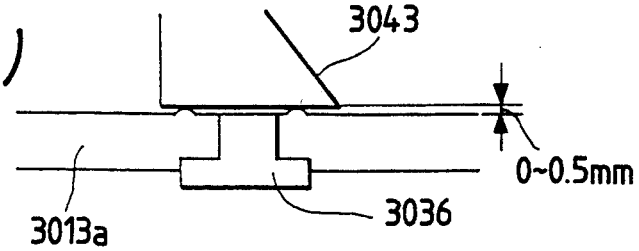
Figure 27D:
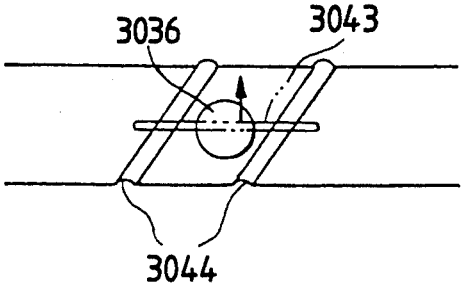
Figure 27E:
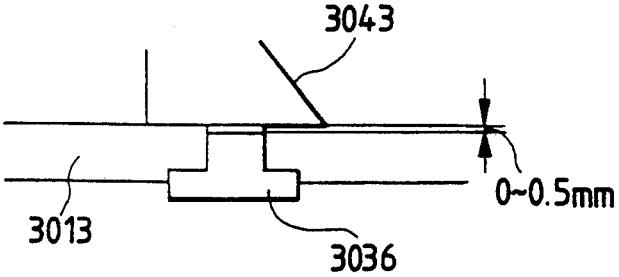

As shown in FIG. 28, a dispenser unit 2041, supported by the main body 2 of the copying machine, is swung between two positions A and B. The dispenser unit 2041 incorporates the cartridge 2012, cartridge set portion 2021, reserve tank 2013, power transmission mechanism 2039, and motor drive means 2040. In the position A as indicated by a dashed line and extended laterally in the main body 2, the cartridge 2012 is set and used. In the position as indicated by a solid line and extended vertically in the main body 2 and located outside the main body, the cartridge 2012 is replaced with a new one. For replacement of the cartridge, the dispenser unit 2041 is turned to the replacing position B. An old cartridge 2012 is removed, and a new cartridge 2012 is set in the cartridge set portion 2021. Thereafter, the dispenser unit is turned to the position A and fixed thereat.

Description to follow is how the toner cartridge 2012 is set to the cartridge set portion 2021. As shown in FIG. 28, a user first turns the dispenser unit 2041 to the replacing position B, and locates the toner cartridge 2012 on the cartridge set portion 2021, as shown in FIGS. 25(*a*) and 26, in a state that the first positioning means 2019 of the cartridge is positioned above and directed horizontally. In this state, the toner cartridge 2012 is axially moved forwardly (to the right in FIG. 16).

If the toner cartridge 2012 is a toner cartridge designed to be used exclusively for the copying machine under discussion, the unlock cam 2014*f* of the toner cartridge 2012 is placed facing the cut-out groove 2023*c*, and the unlock cam 2014*f* is fitted into the cut-out groove 2023*c*. Accordingly, the toner cartridge 2012 is allowed to move up to a preset position on the axial path along which the tubular protrusion 2014*g* is fitted into the circular hole 2022*k* of the cover 2022. If the cartridge containing the incompatible or imitative toner, the unlock cam 2014*f* is placed not facing the cut-out groove 2023*c*. Accordingly, the unlock cam 2014*f* cannot be fitted into the cut-out groove 2023*c*, and hence the toner cartridge cannot be moved up to the preset position. Thus, setting such cartridges to the cartridge set portion 2021 is rejected. In other words, the user will not set an incorrect toner cartridge to the cartridge set portion.

When the unlock 2014*f* is inserted into the cut-out groove 2023*c*, the cam 2014*f* pushes the lock 2022*d* to expel it out of the cut-out groove 2023*c*. Then, the shutter 2023 is slidable in the circumferential direction. In this state, if the toner cartridge 2012 is turned counterclockwise in FIG. 25(*a*) (the user turns it clockwise), the end 2014*h* of the guide member 2014*d* closer to the guide member 2014*d* comes in contact with the end 2023*e* of the cartridge support 2023*a* closer to the shutter portion 2023*b*. Accordingly, the shutter 2023 turns together with the toner cartridge 2012. With rotation of the shutter 2023, the opening 2022*c* of the cover 2022 is opened. One end 2018*a* of the shutter 2018 of the toner cartridge 2012 engages with the engaging part 2022*m*. As a result, if the toner cartridge 2012 is turned, the shutter 2018 will not turn together with the cartridge. In other words, the shutter 2018 turns relative to the toner cartridge 2012, so that the toner supply port 2014*c* is opened. In this way, both the shutters 2018 and 2023 turn in connection with the turn of the cartridge 2012, and the toner supply port 2014*c* and the opening 2022*c* automatically open. When the toner cartridge 2012 is turned, the guide groove 2014*e* forming part of the guide member 2014*d* is fitted into the concave portion 2022*i* of the guide member 2022*h*. The result is that the toner cartridge 2021 is immovable in the axial direction.

The toner cartridge 2012 is then turned at a prescribed angle $\alpha$. The second positioning means 2020 is horizontally postured, so that the toner cartridge 2012 is set in place. When the toner cartridge 2012 is set in place, the toner supply hole 2014*c* and the opening 2022*c* are both opened. Accordingly, toner is introduced from the toner cartridge 2012 into the toner introducing portion 2017*c* of the reserve tank 2017, through the toner supply hole 2014*c* and the opening 2022*c*. Finally, the dispenser unit 2041 is turned to set the toner cartridge 2012 to the position A. Here, the setting of the toner cartridge is complete.

When the toner in the cartridge 2012 is used up and the cartridge must be replaced with a new one, a user turns the dispenser unit 2041 to set the cartridge 2012 to the replacing position B. Then, he turns clockwise the cartridge 2012 till the first positioning means 2019 is set horizontally in FIG. 25(*a*). In this state, the guide member 2014*d* slips out of the concave portion 2022*i* of the guide member 2022*h*, and the shutter 2023 turns to open the opening 2022*c*. The shutter 2018 also moves relative to the toner cartridge to close the toner supply port 2014*c*.

Then, the toner cartridge 2012 is axially moved to the left in FIG. 16, and then the toner cartridge 2012 may be removed. With the movement of the toner cartridge 2012, the unlock cam 2014*f* gets out of the cut-out groove 2023*c*, and the lock 2022*d* is fitted into the groove 2023*c*. The result is that the shutter 2023 is locked to be immovable in the circumferential direction. The user discards the empty toner cartridge and sets a new toner cartridge 2012 filled with toner. The setting operation is the same as mentioned above, and hence no further description will be given here.

It should be understood that in the description thus far made, the present invention is applied to the color copying machine, but it may be applied to other image forming apparatuses.

As seen from the foregoing description, the empty sensor is disposed so as not to be little influenced by the leaked toner, and arranged so as to sense such an amount of left toner as to allow a prescribed number of copies. The amount of the toner left can be accurately sensed. The accurate sensing of the left toner leads to improved reliability of the left toner sensing, and provides an optimum timing of the cartridge replacement.

Further, the left toner sensing is automatically removed in synchronism with the loading of the toner cartridge. Therefore, the left-toner removal is quick, smooth and reliable.

Additionally, a two-contact switch is used for the switch removing the left-toner sensing. The two contacts of the switch are alternately turned on when the toner cartridge is loaded and removed. The contact being in an on state is stored in the nonvolatile memory of the copying machine. Upon sensing of a state change of the on-state the contact, the empty or left-toner sensing is removed and the replacement of the toner cartridge is detected. With this prominent characteristic, if a user turns off the power switch of the image forming apparatus at the time of cartridge replacement, the empty sensing removal and the cartridge-replacement detection can be surely performed.

Furthermore, the empty sensing is removed in response to a cartridge loading signal. The empty sensor is inhibited from sensing an empty state during a period from the empty sensing till a prescribed number of dispensing operations are completed. The amount of toner left in the toner cartridge is predicted on the basis of the result of counting the number of dispensing operations. Therefore, the reliability of the dispensing system is remarkably improved.

What is claimed is:

1. A toner cartridge for a toner supply device of an image forming apparatus, comprising:

a tubular main body having a tubular portion, end walls and a toner supply port;

a spiral agitator, disposed within the main body, having a free end that does not contact an inner surface of either of the end walls of the main body;

drive means for rotating said spiral agitator;

a drive force transmission shaft, integrally formed with the spiral agitator, having a first end connected to an end of the spiral agitator opposite to the free end and having a second end coupled to said drive means, for transmitting a rotating drive force from the drive means to the spiral agitator; and a crushing member for crushing lumps of toner formed as a portion of the drive force transmission shaft near the toner supply port;

wherein said toner cartridge is removably set to the toner supply device and provides toner to the toner device while being set to the toner supply device, and wherein the free end of the spiral agitator is located near the toner supply port and the second end of the drive force transmission shaft, and the end of the spiral agitator opposite to the free end is rotatably supported by the inner surface of one of the end walls of the main body.

2. The toner cartridge according to claim 1, wherein when a load is applied to the spiral agitator, the spiral agitator decreases in diameter.

3. The toner cartridge according to claim 1, wherein the spiral agitator is a spirally coiled metal wire.

4. The toner cartridge according to claim 1, wherein the tubular portion of the main body is made of paper.

5. The toner cartridge according to claim 1, wherein the toner supply port supplies toner to a reserve tank in a toner dispensing section of an image processing apparatus.

6. The toner cartridge according to claim 1, wherein said drive means comprises a motor, a power transmission mechanism connected to the motor, and a coupling connecting the power transmission mechanism and the drive force transmission shaft.

7. The toner cartridge according to claim 1, wherein the spiral agitator contacts the tubular portion of the main body when the spiral agitator is at rest.

8. The toner cartridge according to claim 1, wherein the crushing member is triangular and is formed as a portion of the drive force shaft.

* * * * *